US008240074B2

(12) United States Patent
Vuksanovich

(10) Patent No.: US 8,240,074 B2
(45) **Date of Patent: *Aug. 14, 2012**

(54) METHOD FOR MOUNTING FIREARM BARREL

(75) Inventor: Brian Vuksanovich, Poland, OH (US)

(73) Assignee: Sturm, Ruger & Company, Inc., Southport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/311,704

(22) Filed: Dec. 6, 2011

(65) Prior Publication Data

US 2012/0090150 A1 Apr. 19, 2012

Related U.S. Application Data

(62) Division of application No. 12/409,783, filed on Mar. 24, 2009, now Pat. No. 8,087,194.

(51) Int. Cl.
*F41A 21/00* (2006.01)

(52) U.S. Cl. ..... 42/75.02

(58) Field of Classification Search ..... 42/75.01, 42/75.02, 86

See application file for complete search history.

(56) References Cited

U.S. PATENT DOCUMENTS 255,523 A * 3/1882 Lightburne, Jr. ..... 285/88
4,357,137 A * 11/1982 Brown ..... 464/75
4,555,860 A * 12/1985 Zedrosser ..... 42/25
4,765,224 A * 8/1988 Morris ..... 89/191.01
5,937,563 A * 8/1999 Schuetz et al. ..... 42/106
6,609,319 B1 * 8/2003 Olson ..... 42/16
6,671,990 B1 * 1/2004 Booth ..... 42/75.01
6,752,061 B2 * 6/2004 Baumann et al. ..... 89/14.05
6,959,509 B2 * 11/2005 Vais ..... 42/75.02
6,971,202 B2 * 12/2005 Bender ..... 42/16
7,076,904 B1 * 7/2006 Rustick ..... 42/75.02
2004/0049964 A1 * 3/2004 Vais ..... 42/75.02
2005/0081707 A1 * 4/2005 Herring ..... 89/33.14
2006/0010748 A1 * 1/2006 Stoner et al. ..... 42/71.01
2007/0033851 A1 * 2/2007 Hochstrate et al. ..... 42/75.01
2007/0193102 A1 * 8/2007 Briggs ..... 42/76.02
2007/0199435 A1 * 8/2007 Hochstrate et al. ..... 89/191.02
2010/0319231 A1 * 12/2010 Stone et al. ..... 42/71.01
2011/0000119 A1 * 1/2011 Desomma et al. ..... 42/75.02

* cited by examiner

*Primary Examiner* — Michael Carone
*Assistant Examiner* — Samir Abdosh
(74) *Attorney, Agent, or Firm* — Duane Morris LLP; Frank J. Spanitz

(57) ABSTRACT

A barrel retaining system for a firearm includes a firearm receiver having a barrel nut coupled thereto and a barrel assembly, which in one embodiment may include a barrel with a barrel extension coupled thereto. The barrel extension includes a plurality of barrel locking lugs that rotatably engage corresponding locking elements disposed on the barrel nut. The barrel extension may further include a flange that may engage one end of the locking elements of the barrel nut and the barrel locking lugs may engage an opposite end of the locking elements to wedge the locking elements therebetween for securing the barrel extension to the barrel nut. The firearm may be an autoloading rifle in some embodiments.

20 Claims, 13 Drawing Sheets

METHOD FOR MOUNTING FIREARM BARREL

CROSS-REFERENCE TO RELATED APPLICATIONS

This application is a divisional application of U.S. application Ser. No. 12/409,783 filed Mar. 24, 2009, which is incorporated herein by reference in its entirety firearms.

BACKGROUND OF THE INVENTION

The present invention generally relates to firearms, and more particularly to barrel retaining mechanisms for semi-automatic and automatic firearms.

Various arrangements are known to secure the barrel of a firearm to the receiver or frame. One known basic barrel retaining system used is to form a simple threaded connection between the breech end of the barrel and the receiver or frame. Other arrangements have been employed, however, on semi-automatic/automatic auto-loading rifles like the military and law enforcement versions of the M4-type and M16-type carbines, and semi-automatic counterparts such as AR-15 type carbines. The extreme operating conditions of rapid-fire automatic weapons results in rapid wearing down of rifling in the bore of the barrel, thereby requiring periodic replacement of the barrel sometimes during the exigencies of combat. In addition, it is sometimes be desirable to swap out barrel configurations and/or lengths depending on changing field conditions or combat environments encountered in which the automatic carbines will be used. For example, shorter lighter barrels are often desirable for close-quarters engagement like building sweeps. Longer heavier barrels may be needed in other situations for improved accuracy when firing at greater distances. Accordingly, it is desirable that today's semi-automatic/automatic rifles have readily replaceable barrels and be quickly adaptable to the situation at hand.

A known barrel retaining system used in M16-type carbines provides a detachable barrel that may be separated from the upper receiver for replacement. One such arrangement is generally shown in U.S. Pat. No. 6,971,202. This arrangement utilizes a threaded nipple on the front of the receiver that receives a threaded cast aluminum or steel barrel nut having complementary mating internal threads. Except for the threading and sometimes castellated collar for gripping with a wrench, the barrel nut is a generally plain tubular structure and acts much as an ordinary nut. The breech end of the steel barrel has a short stub-like tubular extension that is equipped with an annular flange spaced inwards from the end of the extension. The barrel extension may be an integral part of the barrel or may be a separate tubular component that is threaded onto the breech end of the barrel. The barrel extension further contains internal bolt-locking lugs with angled feed ramps for loading cartridges into the chamber formed in the breech end of the barrel. The bolt-locking lugs in the barrel extension engage bolt lugs formed on the forward end of a rotatable and axially reciprocating steel bolt slidably mounted in the receiver to provide a steel-to-steel lockup for withstanding the forces of combustion when the rifle is fired. The barrel is attached to the receiver by inserting the barrel extension through the threaded nipple into the receiver until the barrel extension flange is abutted against the receiver. The barrel nut is then slipped partially over the stub portion of the barrel and flange, and threaded onto the receiver nipple thereby trapping the barrel flange between an annular shoulder formed in the barrel nut and the receiver to secure the barrel. In an alternative reverse arrangement of this type barrel retaining system, the barrel nut may be externally threaded and the receiver contains a bore having mating internal threads as shown in U.S. Patent Application Publication No. US2007/0033851. In either of the foregoing arrangements, the barrel is held to the receiver by trapping the barrel flange against the receiver with the barrel nut.

The foregoing combination barrel nut/barrel flange retaining system does not lend itself to rapid barrel swapping and makes it cumbersome to exchange barrels under field conditions. The barrels of the foregoing rifles also become extremely hot during rapid fire automatic mode or semi-automatic mode and are difficult to handle directly with unprotected hands. The handguard, which typically surrounds such barrels typically must be at least partially disassembled in some designs often requiring additional tools to gain access to the barrel nut. Specialized tools such as barrel nut wrenches may also be required to unthread and subsequently reinstall the barrel nut with an appropriate torque preload. In summary, the barrel exchange process with the conventional barrel nut arrangement is cumbersome and time consuming, and not well suited for rapid barrel swapping particularly under combat conditions.

An improved barrel retaining system having quick-change characteristics is desirable.

SUMMARY OF THE INVENTION

The present invention provides a firearm with a quick-change barrel retaining system suitable for use in rifles and other firearms. In a preferred embodiment, the barrel is secured to the rifle by a locking member such as a barrel nut which preferably is attached to receiver. Although in one embodiment the barrel nut may be similarly threaded onto the receiver assembly like a conventional barrel nut in the usual manner, the barrel nut according to the present invention is configured and adapted to accomplish the barrel locking function in a different manner. Unlike known barrel nuts described heretofore that secure the barrel to the receiver by trapping an annular barrel flange between the barrel nut and receiver, the present barrel nut in a preferred embodiment is specially configured to directly engage the rifle barrel such that a locking relationship is formed between the barrel nut and barrel independently of the receiver. Advantageously, unlike known prior barrel nuts, the present barrel nut does not require removal or other manual manipulation by a user in order to remove the barrel from the rifle. The present barrel nut may remain attached to the receiver assembly and stationary in position when a barrel is removed or installed, as will be further described herein. Advantageously, this allows the barrel to be quickly changed without tools while retaining the originally set point of aim for the new barrel because the barrel nut remains fixed to the firearm. Therefore, each new barrel need not be re-sighted after installation which is particularly important during field combat conditions. Also advantageously, the handguard and components supported by or mounted to the handguard also do not require partial disassembly or removal in order to replace the barrel. Preferably, the barrel retaining system does not require the use of any separate tools to remove the barrel from the firearm.

In some preferred embodiments, a barrel retaining system according to principles of the present invention provides a releasable dual locking mechanism intended to improve the tightness and reliability of the coupling between the barrel and rifle. The barrel retaining system reduces or eliminates possible vibration/rattling when the rifle is discharged. In some embodiments, an additional third locking mechanism may be provided to further enhance a secure locking relationship between the barrel and rifle. In one embodiment, the three locking mechanisms detachably lock the barrel to the rifle at three different axial locking locations for improved tightness. In one embodiment, one locking mechanism may be provided by barrel locking lugs formed on a barrel assembly that mate with corresponding locking elements such as splines formed on a barrel nut. A second locking mechanism may be provided by engagement between a flange on the barrel assembly with the barrel nut splines. A third locking mechanism may be provided by frictional engagement between a tapered contact surface on the barrel assembly with the barrel nut splines. The foregoing locking mechanisms and associated structures are further described herein.

According to one embodiment, a barrel retaining system for a firearm includes: a receiver defining a cavity that receives a reciprocating bolt; a barrel having a bore defining a longitudinal axis and an axial path for a bullet; a barrel extension coupled to the barrel, the barrel extension including a plurality of barrel locking lugs extending radially outwards from the barrel extension, the barrel extension being rotatable between unlocked and locked positions; and a barrel nut attached to the receiver and being configured to receive the barrel extension at least partially therein, the barrel nut including a plurality of internal splines configured to engage the barrel locking lugs, wherein when the barrel extension is inserted into the barrel nut and rotated into the locked position, the barrel locking lugs engage the splines to secure the barrel to the firearm.

According to another embodiment, a barrel retaining system for a firearm includes: a receiver having a front and defining a cavity configured to receive a reciprocating bolt; a barrel having a bore defining a longitudinal axis and an axial path for a bullet; a barrel extension removably attached to the barrel, the barrel extension including a plurality of barrel locking lugs extending radially outwards from the barrel extension and an annular flange disposed forward of the locking lugs, the barrel extension being rotatable between unlocked and locked positions; a barrel nut extending in a forward axial direction from the front of the receiver, the barrel nut being configured and adapted to receive the barrel extension; a plurality of longitudinally-extending splines formed on the barrel nut that protrude radially inwards therefrom, the splines being configured and adapted for engaging the barrel locking lugs and flange, the splines defining a plurality of channels therebetween configured and adapted for slidably receiving the barrel locking lugs to enable the barrel extension to be inserted into the barrel nut; an annular locking groove formed in the barrel nut that communicates with the channels, the locking groove being configured and adapted to receive the barrel locking lugs and allow the lugs to be rotated when positioned in the groove. In one embodiment, inserting the barrel extension into the barrel nut by sliding the barrel locking lugs of the barrel extension along the channels of the barrel nut into the locking groove, and rotating the barrel extension into the locked position engages each spline with one of the barrel locking lugs and a forward portion of the barrel extension to secure the barrel to the firearm. In one embodiment, the forward portion of the barrel extension defines an annular frustoconical portion forming a tapered contact surface that is frictionally engaged by at least some of the splines when the barrel extension is inserted into the barrel nut and rotated. In some embodiments, at least some of the barrel locking lug include a means for axially displacing the barrel extension with respect to the barrel nut when the barrel extension is inserted into the barrel nut and rotated with respect to the barrel nut. In one embodiment, the means for axially displacing the barrel extension is formed by an angled camming notch that slidably engages a rear end of each spline and axially displaces the barrel extension rearward with respect to the barrel nut upon rotation of barrel extension.

In another embodiment, a firearm with a detachable barrel includes: a receiver having a front and defining a cavity that receives a reciprocating and rotatable bolt having bolt lugs; a barrel assembly having a breech end, a muzzle end, and a bore defining an axial path for a bullet, the barrel assembly including bolt locking lugs for releaseably engaging the bolt lugs for forming a locked breech and a plurality of barrel locking lugs extending radially outwards from barrel assembly; and a barrel nut attached to the receiver and receiving a portion of the barrel assembly therein, the barrel nut including a plurality of locking elements being configured and adapted to engage the barrel locking lugs. In one embodiment, the barrel assembly is rotatable in a first direction to engage the barrel locking lugs with the locking elements to lock the barrel assembly to the firearm, and the barrel assembly is rotatable in a second opposite direction to disengage the barrel locking lugs from the locking elements to unlock the barrel assembly from the firearm.

In another embodiment, a firearm with a detachable barrel includes: a receiver having a front and defining a cavity that receives a reciprocating bolt having bolt lugs; a barrel nut attached to the front of the receiver, the barrel nut including a plurality of longitudinally-extending splines extending radially inwards from an interior surface of the barrel nut, the splines each including a front end and an opposite rear end defining a length therebetween; and a barrel extension at least partially insertable into the barrel nut and rotatable therein for coupling a barrel to the barrel nut, the barrel extension being configured and arranged to engage both the front and rear ends of the splines upon rotation of the barrel extension when positioned in the barrel nut for locking the barrel extension to the barrel nut.

A method for attaching a barrel to a firearm is also provided. In one embodiment, the method includes: axially inserting at least a portion of a barrel assembly into a barrel nut attached to a receiver or frame of the firearm; rotating the barrel assembly in a first direction; and engaging a plurality of barrel locking lugs on the barrel assembly with the barrel nut such that the barrel assembly cannot be axially removed from the barrel nut.

BRIEF DESCRIPTION OF THE DRAWINGS

The features of the preferred embodiments will be described with reference to the following drawings where like elements are labeled similarly, and in which.

Figure 1:
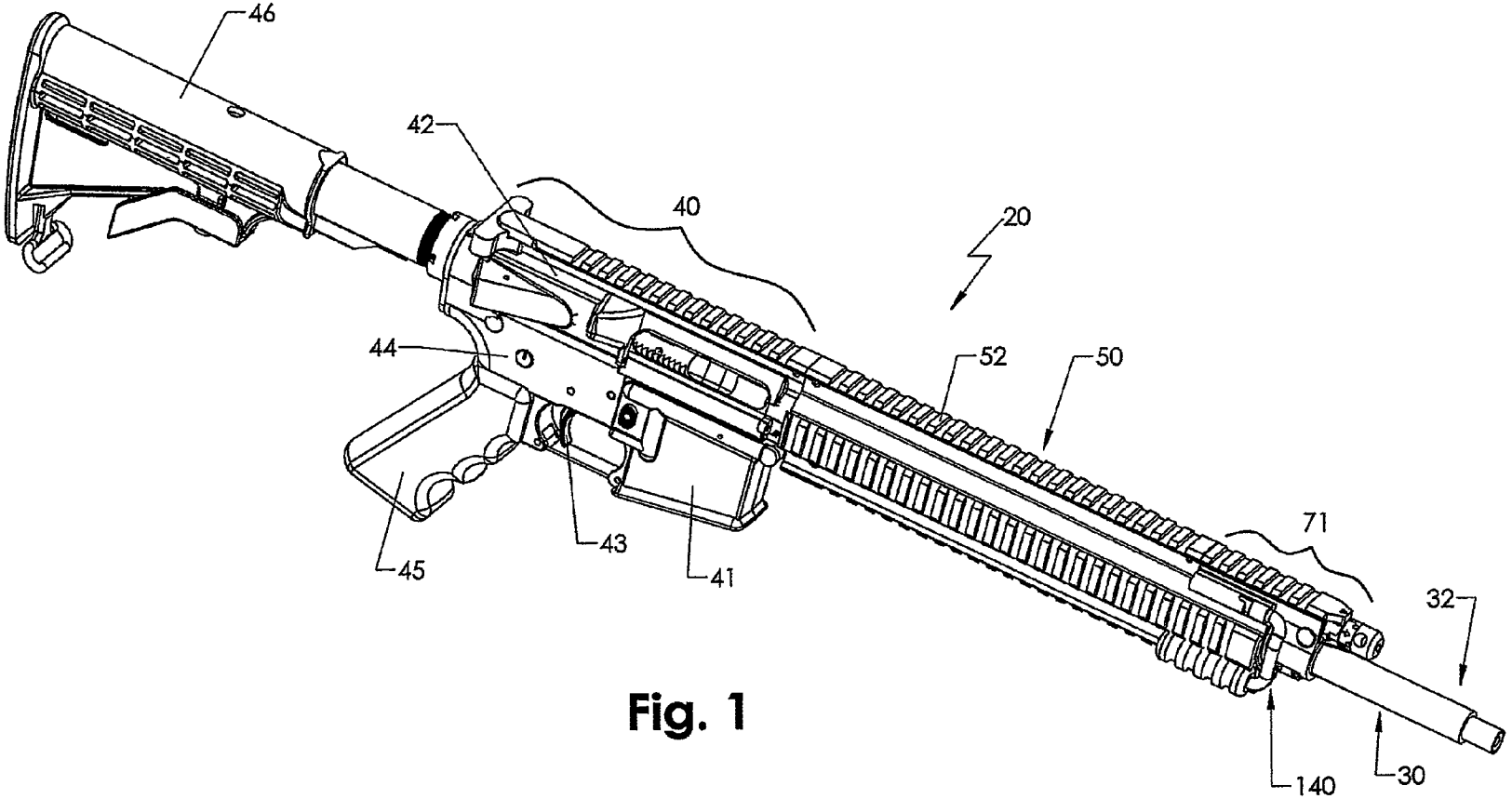
FIG. 1 is a perspective view of one embodiment of a rifle according to principles of the present invention.

All drawings are schematic and not to scale.

DESCRIPTION OF PREFERRED EMBODIMENTS

The features and benefits of the invention are illustrated and described herein by reference to preferred embodiments. Accordingly, the invention expressly should not be limited to such preferred embodiments illustrating some possible non-limiting combination of features that may exist alone or in other combinations of features; the scope of the invention being defined by the claims appended hereto. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. The term "action" is used herein with respect to rifles in its conventional sense being the combination of the receiver, bolt, and other components associated with performing the functions of loading and unloading cartridges and locking and unlocking the breech.

A preferred embodiment of a barrel retaining system with quick-change capabilities will now be described for convenience with reference and without limitation to a rifle capable of semi-automatic or automatic firing. However, it will be appreciated that alternate embodiments formed according to principles of the present invention may be used with equal advantage for other types of firearms and the invention not limited in applicability to rifles alone as described herein.

Figure 2:
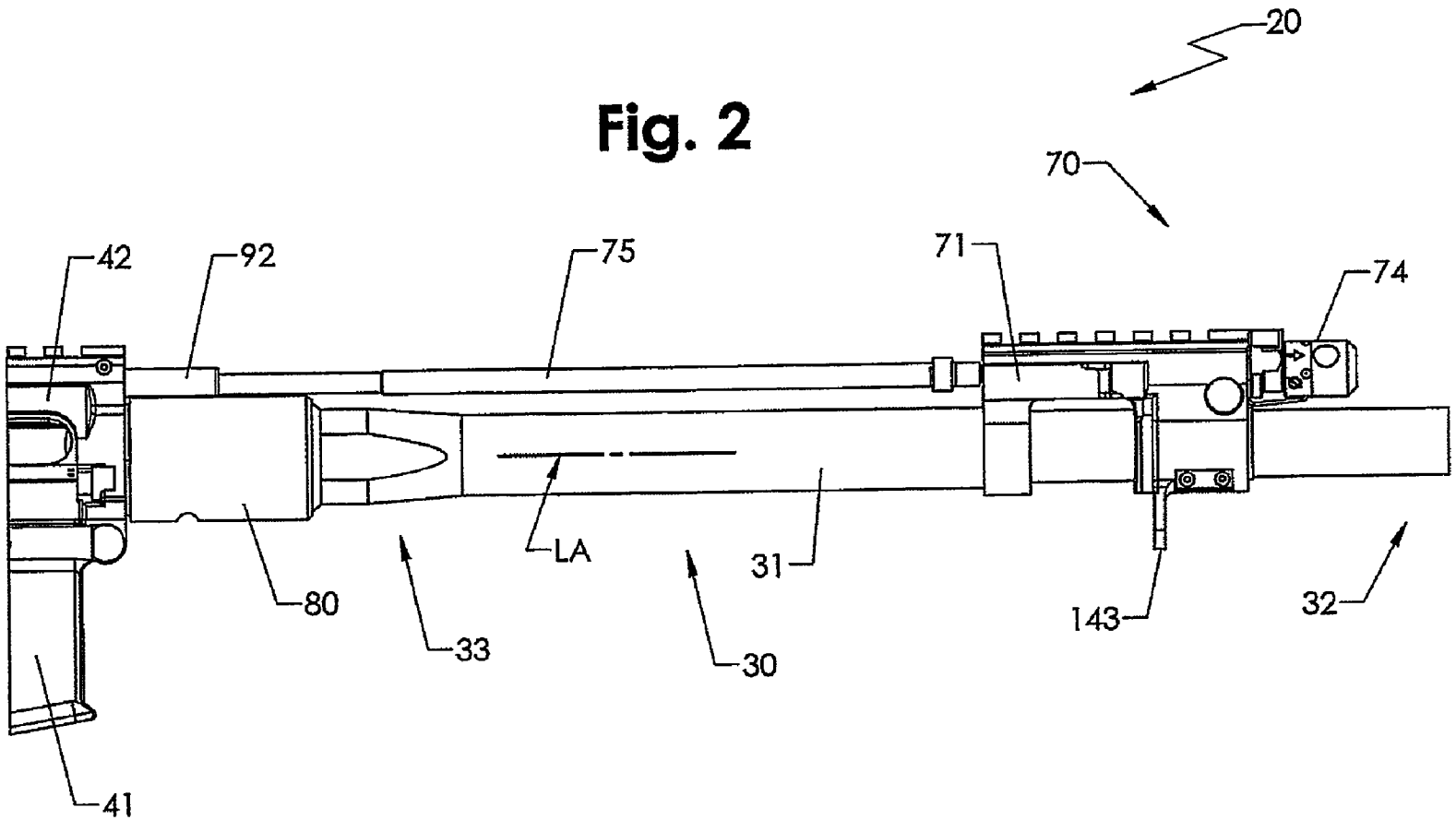
FIG. 2 is a partial side view of the rifle with handguard removed.

FIGS. 1 and 2 show a preferred embodiment of a rifle 20 according to principles of the present invention. In one embodiment, rifle 20 may preferably be a gas-operated auto-loading rifle with a rotating bolt-type action and magazine feed. FIG. 2 depicts the barrel portion of rifle 20 with the handguards removed to better show the arrangement of components hidden from view when the handguard is in place. As further described herein, rifle 20 includes a quick-change barrel retaining system intended to facilitate convenient and quick swapping of barrels in situations that include the combat arena.

Referring now to FIGS. 1 and 2, rifle 20 generally includes a receiver assembly 40 and a barrel assembly 30 mounted thereto via a locking member such as barrel nut 80. Receiver assembly 40 may house a conventional firing mechanism and related components such as those used in M-4 and M-16/AR-15 type rifles and their variants. Such firing mechanisms are generally described in U.S. Pat. Nos. 5,726,377 and 4,433,610, both of which are incorporated herein by reference in their entireties. As will be known to those skilled in the art, these firing mechanisms generally include a spring-biased hammer that is cocked and then released by a sear upon actuating the trigger mechanism. The hammer strikes a firing pin carried by the bolt, which in turn is thrust forward to contact and discharge a chambered cartridge. A portion of the expanding combustion gases traveling down the barrel is bled off and used to drive the bolt rearward against a forward biasing force of a recoil spring for automatically ejecting the spent cartridge casing and automatically loading a new cartridge into the chamber from the magazine upon the bolts forward return. Such recoil spring systems are generally described U.S. Pat. No. 2,951,424, which is incorporated herein by reference in its entirety. In a gas direct type system such as employed on M4 and M16-type rifles, the gas is directed rearwards through a tube to the breech area of the receiver and into a gas chamber associated with a reciprocating bolt carrier that holds the bolt. The gas acts directly on the bolt carrier. In a gas piston type system, such as used in AR-18 and AK-47 type rifles, the combustion gases are ported into a gas cylinder mounted on the barrel which contains a reciprocating piston. An operating or transfer rod mechanically links the piston to the bolt carrier in lieu of gas tube to drive the bolt carrier rearward after firing the rifle. The gas thus acts on the piston, which is remote from the breech area of the receiver and only mechanically linked to the bolt carrier. This latter type system generally keeps the breech area of the receiver cleaner than gas direct systems by reducing fouling and carbon accumulation on components from the combustion gases. Gas direct systems require more frequent cleaning and are generally more prone to malfunctions and misfires resulting from fouling. In addition, the piston system runs cooler than gas direct preventing components from getting hot and expanding (particularly during automatic firing mode) which can also result in malfunctions. In a preferred embodiment, the barrel retaining system according to principles of the present invention is preferably used in conjunction with a rifle employing a gas piston type system, which will be further described herein in pertinent part.

Referring now to FIGS. 1 and 2, receiver assembly 40 includes upper receiver 42 and lower receiver 44 which may be removably coupled together by conventional means. In some embodiments, upper receiver 42 may generally be a conventional M4 or M-16/AR-15 type upper receiver with modifications as described herein. Lower receiver 44 includes a buttstock 46, handgrip 45, trigger mechanism 43, and open magazine well 41 that removably receives a self-feeding magazine (not shown) for holding a plurality of cartridges. In some embodiments, the cartridges used may be 5.56 mm NATO rounds or other cartridge types suitable for use in semi-automatic and automatic rifles.

Bolt and Carrier: In one embodiment, a conventional rotating bolt is provided as commonly used in M4-type and M16/AR-15-type rifles. Referring to FIGS. 3, 4, and 8A-B, upper receiver 42 defines an internal longitudinally-extending cavity 47 configured to receive bolt assembly 60. Bolt assembly 60 is slidably disposed in cavity 47 for axial reciprocating recoil movement rearward and forward therein. Bolt assembly 60 includes a bolt carrier 61 and a rotatable bolt 62 such as generally described in U.S. Pat. Nos. 5,726,377, 4,3433,610, and 2,951,424, which are all incorporated herein by reference in their entireties. Bolt 62 is disposed in bolt carrier 61 in a manner that provides rotational and axial sliding movement of the bolt with respect to bolt carrier 61 in a conventional manner. When bolt assembly 60 is mounted in upper receiver 42, forward breech face 63 of bolt 62 protrudes outwards from inside bolt carrier 61 towards the front of rifle 20 for abutting a chambered cartridge when loaded in chamber 111 (see FIG. 13). A firing pin 200 (shown in FIGS. 3 and 4) is disposed in firing pin cavity 63 (see FIG. 4) for sliding axial movement therein to strike the chambered cartridge when struck on its rear by the hammer (not shown). Bolt 62 preferably includes a conventional transverse-mounted cam pin 67 that travels in a curved cam slot 68 defined by bolt carrier 61 to impart rotational movement to the bolt and limit its degree of rotation. Preferably, bolt 62 is made of steel. Bolt carrier 61 further includes a key 65 attached to or integral with the carrier. Key 65 includes a forward-facing thrusting surface 66 for engaging the transfer rod of the gas piston operating system described herein for cycling the action.

With continuing reference to FIGS. 3, 4, and 8A-B, bolt 62 further includes conventional laterally-protruding bolt lugs 64 located proximate to bolt breech face 63. Bolt lugs 64 extend outwards in a radial direction from bolt 62 and engage corresponding bolt locking lugs 105 associated with barrel assembly 30 to lock the breech prior to firing the rifle 20. In one preferred embodiment, bolt locking lugs 105 are formed in a preferably steel barrel extension 100 that is affixed to or integral with barrel 31. This provides a steel-to-steel locked breech when a chambered cartridge is detonated by the firing pin 200 after actuating the rifle's trigger mechanism. This steel-to-steel breech lockup withstands combustion forces and allows receiver assembly 40 to made of a lighter material, such as aluminum or aluminum alloy for weight reduction.

Barrel Assembly: Barrel assembly 30 will now be further described with initial reference to FIGS. 1-3, 5-7, and 13. Barrel assembly 30 includes a barrel 31 having a muzzle end 32 and breech end 33. Barrel 31 defines a longitudinal axis LA for rifle 20 and an inner barrel bore 34 that forms an axial path for a bullet. A portion of barrel bore 34 is enlarged near the breech end 33 to define a chamber 111 that holds a cartridge. Preferably, inner barrel bore 34 includes conventional rifling (not shown) in some embodiments for imparting spin to the bullet when rifle 20 is fired. A gas block 71 forming part of a gas piston operating system 70 is shown mounted towards the muzzle end 32 of barrel assembly 30. The gas piston operating system 70 is further described elsewhere herein.

Figure 3:
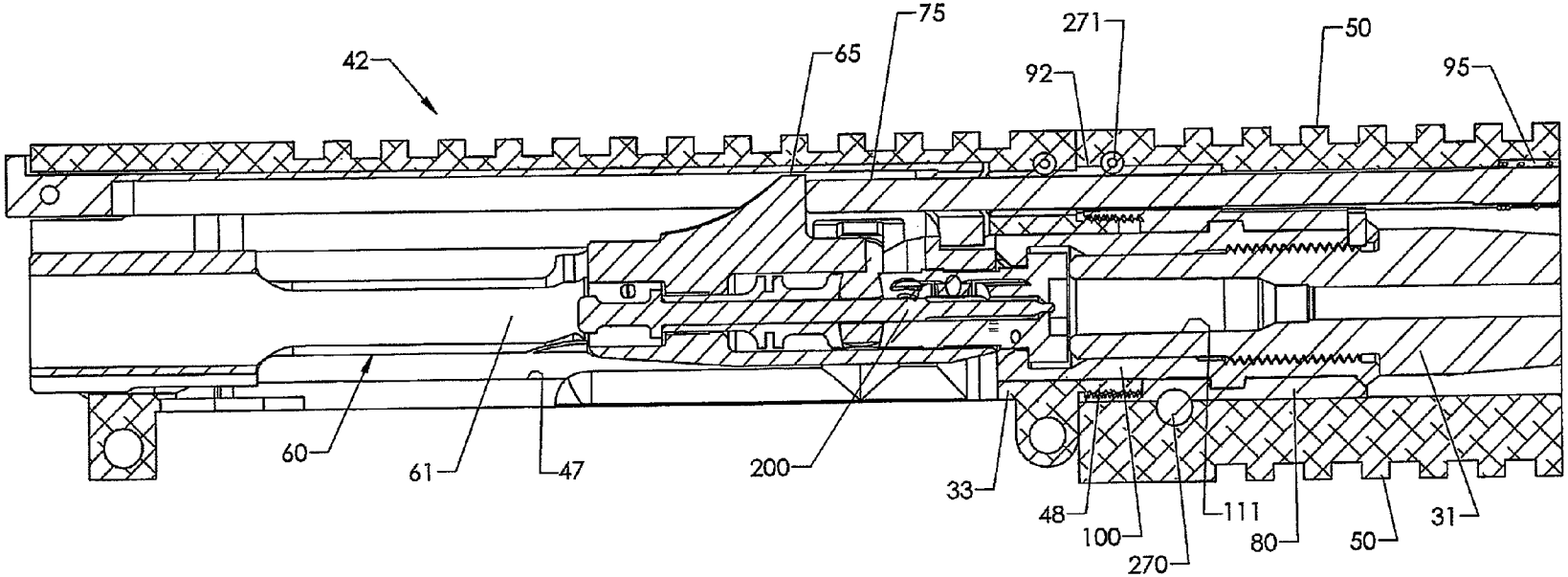
FIG. 3 is a partial cross sectional view of the upper receiver and breech end of the barrel of the rifle.
Figure 4:
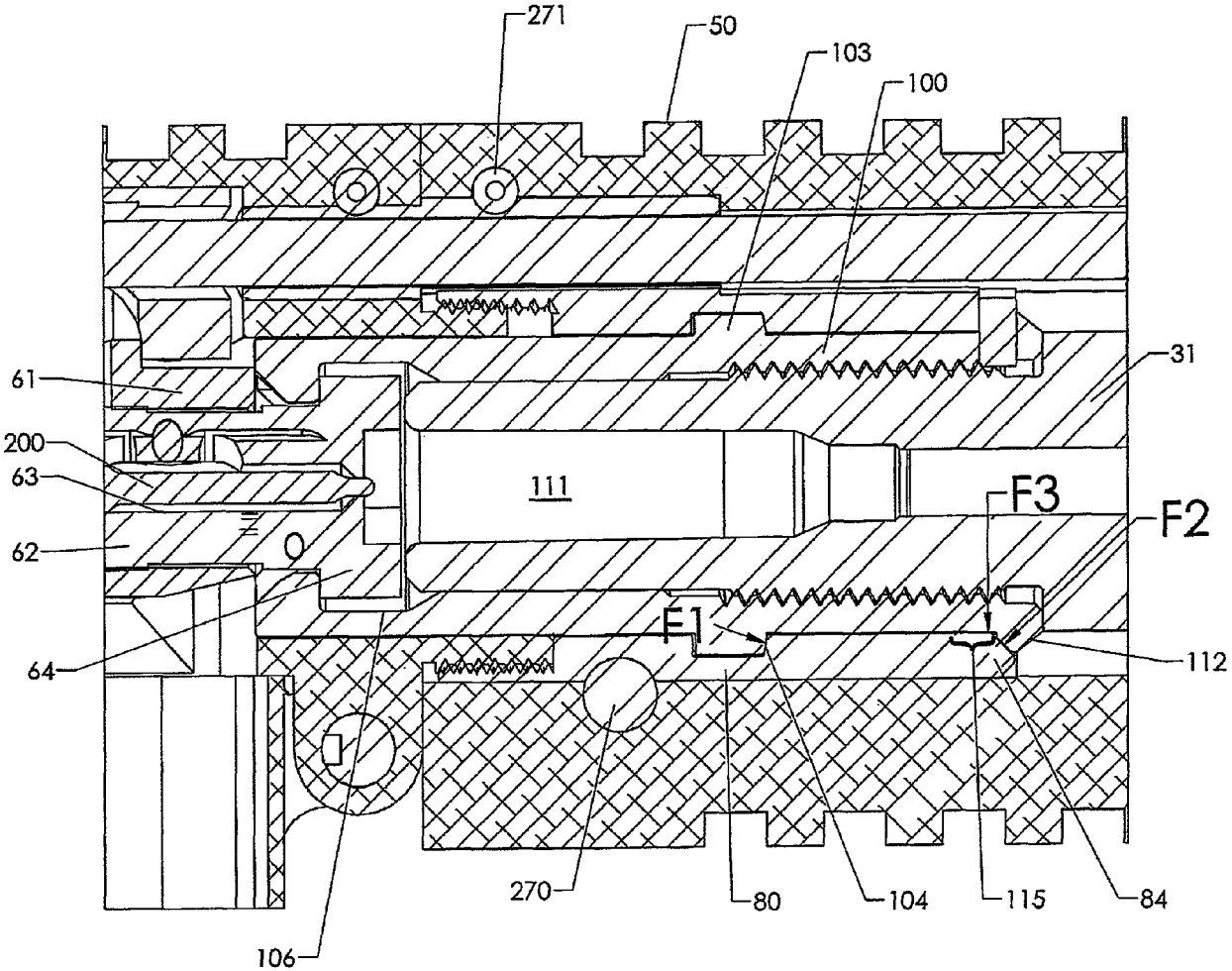
FIG. 4 is a detailed partial cross sectional view of the breech end of the barrel including the bolt, barrel extension, and barrel nut.

With additional reference now to FIGS. 14-20, barrel assembly 30 further includes a barrel extension 100 at breech end 33 of barrel 31. Barrel extension 100 defines an exterior surface 101 and an interior surface 102. A portion of exterior surface 101 defines an annular surface 114 for locating and receiving splines 81 of barrel nut 80. In one embodiment, annular surface 114 preferably extends axially in a longitudinal direction and may be formed between an annular flange 112 and barrel locking lugs 103 further described herein. Annular surface 114 preferably has an axial length sized to receive splines 81 as best shown in FIGS. 3 and 4.

In a preferred embodiment, barrel extension 100 may be a separate component removably attached to barrel 31 via a threaded connection. Accordingly, in one possible embodiment, barrel extension 100 may have internal threads 107 formed on interior surface 102 proximate to front end 108 which mate with complementary shaped external threads 35 formed proximate to or spaced inwards from breech end 33 of barrel 31 as shown. Other suitable conventional means of affixing barrel extension 100 to barrel 31 such as pins, screws, clamps, etc., or combinations of threading and such other means, may be used.

With continuing reference to FIGS. 14-21, opposite rear end 109 of barrel extension 100 includes conventional circumferentially-spaced bolt locking lugs 105 that project radially inwards from interior surface 102 to engage bolt lugs 64 of rotating bolt 62 (see FIGS. 4 and 8A-B) for closing and locking the breech in preparation for firing rifle 20 in a conventional manner. Rear end 109 of barrel extension 100 includes conventional angled feed ramps 110 to facilitate feeding cartridges into chamber 111 of barrel 31. A diametrically enlarged annular space 106 is provided in interior surface 102 of barrel extension 100 to receive bolt lugs 64 and allow bolt 62 to rotate in a usual conventional manner after bolt lugs 64 are inserted forward through bolt locking lugs 105.

Figure 13:
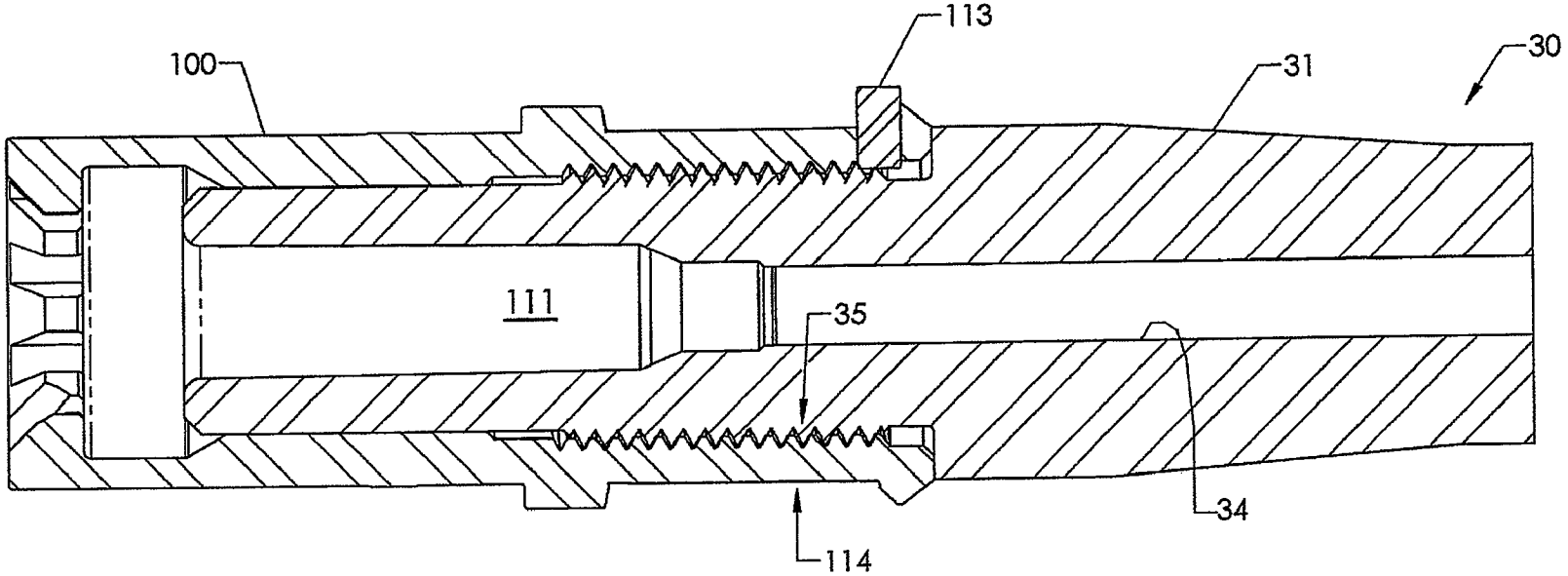
FIG. 13 is a cross-sectional side view of the breech end of the barrel with barrel extension attached thereto.
Figure 14:
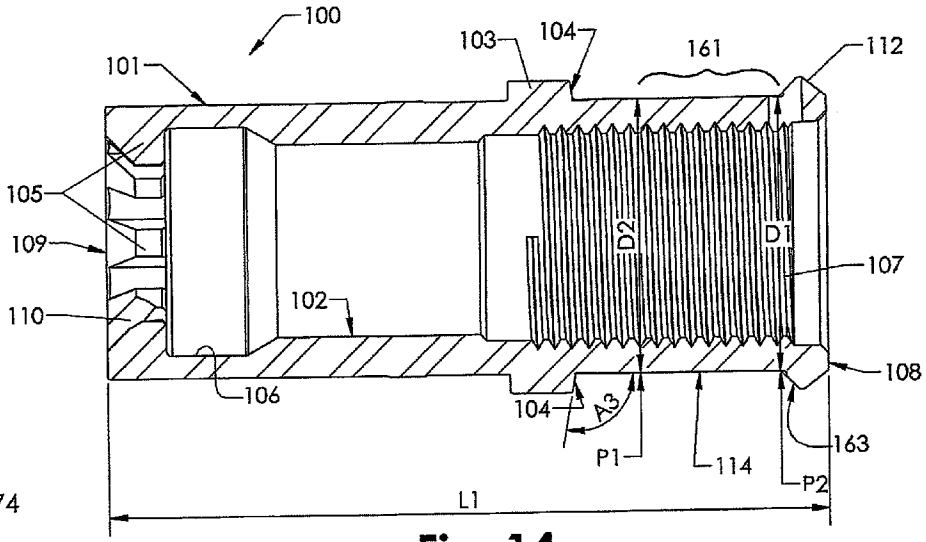
FIG. 14 is a cross-sectional top view of the barrel extension.
Figure 15:
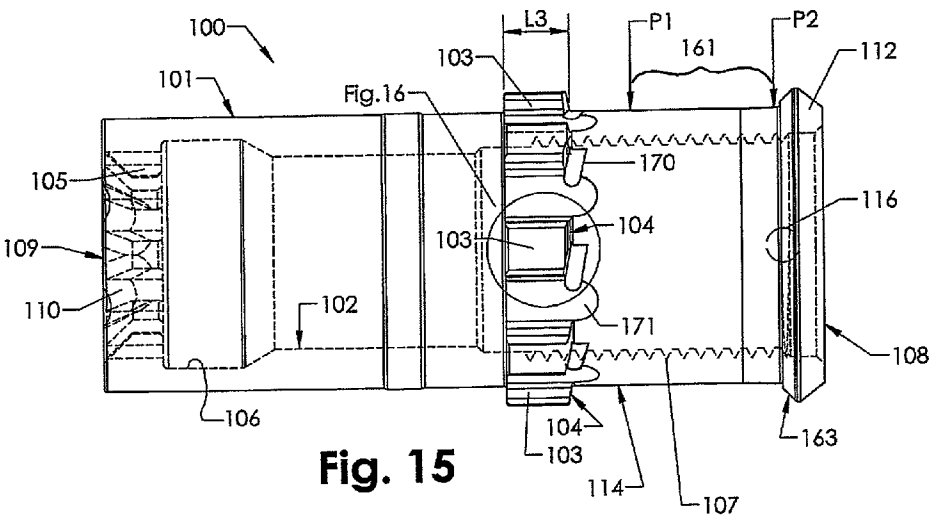
FIG. 15 is top view.

Unlike known barrel extensions, barrel extension 100 preferably includes barrel locking lugs 103 as shown in FIGS. 13-15 for detachably locking barrel assembly 30 to barrel nut 80 via corresponding splines 81 in the barrel nut. The barrel locking lugs 103 define a first locking mechanism for securing barrel assembly 30 to rifle 20. Barrel extension 100 is rotatable between a locked position in which the barrel locking lugs 103 are engaged with splines 81 to lock barrel assembly 30 to rifle 20, and an unlocked position in which barrel locking lugs 103 are not engaged with splines 81 to unlock the barrel assembly 30 from rifle 20. In a preferred embodiment, a plurality of opposing external barrel locking lugs 103 are provided and disposed on barrel extension 100. In other embodiments contemplated, barrel locking lugs may be disposed on barrel 31 (not shown) in alternative designs where no barrel extension is used. However, barrel extensions are favored in a preferred embodiment because the extensions may be detached from the used barrel and re-used on a new barrel. Because bolt locking lugs 105 and barrel locking lugs 103 are machined on barrel extension 100 that may be reused, fabrication of barrel 31 is less expensive. Each barrel assembly can be gauged individually for proper headspace before being installed into the rifle, and when a quick-change barrel system is used according to the present invention, each barrel will maintain headspacing regardless of the rifle it is installed in.

Figure 18:
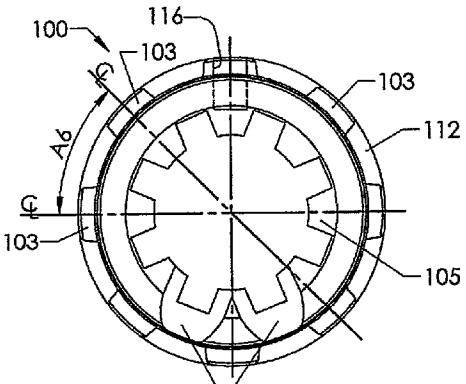
FIG. 18 is an end view of the barrel extension looking towards the breech end of the barrel extension.

As shown in FIGS. 14-21, barrel locking lugs 103 extend radially outwards from exterior surface 101 of barrel extension 100 in a circumferentially spaced apart and opposing relationship. Machined depressions 171 may be formed between the barrel locking lugs 103. As best shown in FIG. 18, by way of example without limitation, eight barrel locking lugs 103 may be provided that correspondingly engage eight splines 81 formed on barrel nut 80. Other suitable numbers of splines 81 and barrel locking lugs 103 may be used. Preferably, the barrel locking lugs 103 have a uniform circumferential spacing such that the lugs are equally spaced around the circumference of barrel extension 100. In one exemplary embodiment, the radial centerline of each barrel locking lugs 103 is angularly arranged at an angle A6 of about +/−45 degrees from each other (see FIG. 18) wherein eight lugs are provided.

In a preferred embodiment, each barrel locking lug 103 includes a front radial locking surface 104 for engaging and interlocking with a corresponding complementary rear radial locking surface 88 on spline 81 of barrel nut 80. Accordingly, barrel locking lugs 103 provide a first locking mechanism for securing barrel extension 100 to barrel nut 80 with an associated compressive locking force F1 (see FIG. 4). Front radial locking surface 104 is oriented generally transverse to longitudinal axis LA when barrel extension 100 is assembled to barrel 31. Preferably, front radial locking surface 104 is disposed at angle A3 with respect to contact surface 115 of barrel extension 100 a shown in FIG. 14. In one exemplary embodiment, angle A3 may be at least about 90 degrees, and about +/−100 degrees in one exemplary preferred embodiment (allowing for fabrication/machining tolerances). Other suitable angles may be used.

Figure 16:
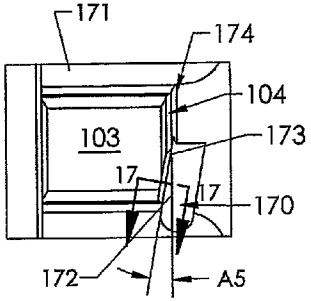
FIG. 16 is a view of detail 16 in FIG. 15 showing a barrel locking lug of the barrel extension.
Figure 17:
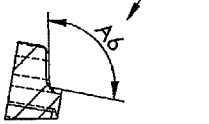
FIG. 17 is a cross-section of the barrel locking lug of FIG. 16 taken along line 17-17.

With reference to FIGS. 15-17 and 19, camming notches 170 may be provided in some embodiments. Camming notches 170 may have a rounded entry portion in some embodiments as shown for receiving radial locking surface 88 on spline 81 of barrel nut 80. Preferably, camming notches 170 are cut at least partially into front radial locking surface 104 of each barrel locking lugs 103 in a preferred embodiment (best shown in FIGS. 16-17). Each camming notch 170 extends partially across front radial locking surface 104 as best shown in FIG. 16. Each camming notch 170 preferably is cut at an angle A5 to the base 174 of locking surface 104 (see FIG. 16) which extends in a transverse direction perpendicular or 90 degrees to longitudinal axis LA of rifle 20 in a preferred embodiment. In some exemplary embodiments, without limitation, angle A5 maybe be at least 5 degrees, and more preferably at least about 10 degrees. Camming notch 170 may be formed with an entrance portion 172 and an opposite exit portion 173, which may the same or narrow in width than the entrance portion.

Camming notches 170 impart an axial relative motion to barrel extension 100 in relation to barrel nut 80 due to the angled orientation of at least a part of the notches with respect to the longitudinal axis LA of barrel assembly 30. The camming notches 170 function to translate rotational motion of barrel extension 100 into axial motion. The camming notches 170 advantageously tightens and enhances the locking relationship between the barrel locking lugs 103 and the tapered contact surface 161 of barrel extension 100 (see FIG. 15) and barrel nut 80 as further described below. This produces a zero-clearance fit both axially and radially between the barrel nut 80 and the barrel extension 100. By the contact between barrel extension radial locking surface 104 and barrel nut groove surface 88 (FIG. 11), the barrel extension 100 (and thereby the entire barrel assembly) is pulled rearward, engaging the barrel extension tapered contact surface 161 (see FIG. 15) with the front edge 265 of the barrel nut (shown in FIGS. 10 and 12). It should be noted that camming notch 170 best shown in FIGS. 15 and 16 is a lead-in so that precise alignment of front radial locking surface 104 (extension lug front face) with rear radial locking surface 88 (also the front surface of barrel nut locking groove 87) is not necessary—notch 170 aligns them when torque is applied by turning the barrel assembly into the barrel nut. Radially-extending annular flange 112 on barrel extension 100 in front of the tapered contact surface 161 serves to prevent over insertion of the barrel extension into the barrel nut 80. In addition, camming notch 170 progressively increases the frictional and compressive engagement between front radial locking surface 104 of barrel locking lugs 103 and rear radial locking surface 88 of splines 88 as the barrel extension 100 is rotated into engagement with barrel nut 80 in relation to the first locking mechanism described above.

Figure 10:
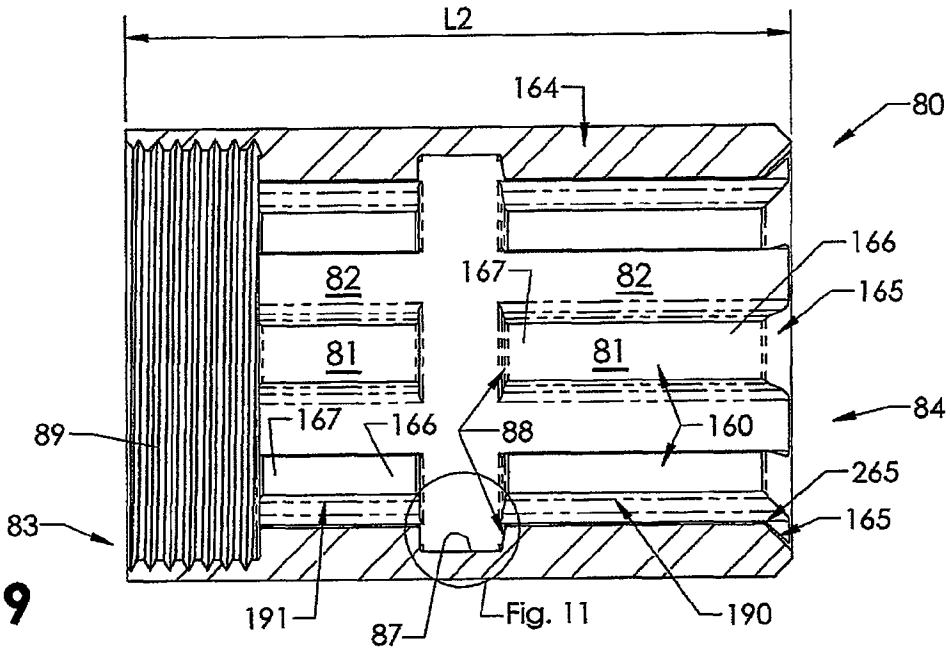
FIG. 10 is a cross-sectional view of the barrel nut.
Figure 11:
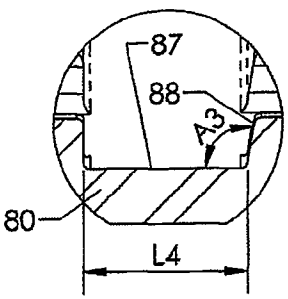
FIG. 11 is a view of detail 11 in FIG. 10.

With continuing reference to FIGS. 15-17 and 19, camming notch 170 is sized and configured to engage rear radial locking surface 88 of splines 81 (see FIGS. 10-11). After fully inserting barrel extension 100 into barrel nut 80 and locating barrel locking lugs 103 in locking groove 87 of the barrel nut, rotating the barrel extension towards a locking position will initially engage a leading edge of rear radial locking surface 88 of spline 81 (at rear end 167) with the entrance portion 172 of notch 170. The rear end 167 of spline 81 travels in notch 170 and slides across front radial locking surface 104 of the barrel locking lugs 103 towards the narrow exit portion 173 of the notch. Continuing to rotate barrel extension 100 causes the leading edge of spline 81 to leave notch 170 until rear radial locking surface 88 of spline 81 fully engages front locking surface 104 of barrel locking lugs 103. The notch 170 imparts axial motion to barrel extension 100 in relation to barrel nut 80 in a manner that displaces the barrel extension slightly rearward due to the angled A5 orientation of notch 170. This both tightens the locking engagement between the barrel locking lugs 103 and splines 81 (see FIG. 4, compressive locking force F1), and also compresses rear angled locking surface 163 of flange 112 against front angled locking surface 165 of each spline as the barrel extension is drawn rearward in relation to barrel nut 80 (see FIG. 4, compressive locking force F2). Accordingly, each end 166, 167 of splines 81 become wedged between the barrel extension flange 112 and barrel locking lugs 103 to form a secure locking relationship between the barrel extension 100 and barrel nut 80. Referring to FIG. 4, compressive locking forces F1, F2 act in opposite and converging directions on either end of splines 81 to produce the wedging effect on the splines.

With continuing reference to FIGS. 14-21, front end 108 of barrel extension 100 includes radially-extending annular flange 112 which in some embodiment provides additional locking engagement between the barrel extension and barrel nut 80. Accordingly, flange 112 provides a second locking mechanism for securing barrel extension 100 to barrel nut 80, which preferably is spaced axially apart from a first locking mechanism provided by barrel locking lugs 103. Flange 112 preferably is located and dimensioned to also properly position barrel locking lugs 103 in locking groove 87 of barrel nut 80 when barrel extension 100 is seated therein and prevent over insertion of the barrel extension into the barrel nut. Preferably, flange 112 is located proximate to front end 108 of barrel extension 100. In other embodiments contemplated, flange 112 may be spaced inwards from front end 108. A rear facing portion of flange 112 defines a rear angled locking surface 163 for cooperatively engaging a complementary front angled locking surface 165 defined on a front end 166 of each spline 81 (as best shown in FIG. 10) to lock barrel extension 100 to barrel nut 80. This creates a compressive locking force F2 between flange 112 and splines 81, as shown in FIG. 4. Preferably, rear angled locking surface 163 and front angled locking surface 165 are both angled as shown in FIG. 4 to provide both an axial and radial interlock that reduces rattling and vibration between barrel extension 100 and barrel nut 80 when rifle 20 is discharged. Rear angled locking surface 163 preferably is circumferentially continuous around barrel extension 100 thereby forming a part of a cone in configuration. Although a continuous flange 112 is preferred for ease of manufacturing, in other embodiments (not shown), flange 112 may be circumferentially discontinuous to define a plurality of separate annular segmented rear angled locking surfaces 163 for engaging front angled locking surfaces 165 of splines 81. Front angled locking surface 165 of barrel nut 80 is preferably disposed on front end 166 of each spline 81 opposite from rear end 167 of the spline having rear radial locking surface 88. Accordingly, each spline defines two opposite facing locking surfaces 88, 165 for engaging barrel extension 100 by wedging each spline between barrel extension flange 112 and barrel locking lugs 103 by compressive locking forces F1, F2 (see FIG. 4) as further described herein. When barrel extension 100 is full inserted into barrel nut 80 and rotated therein, rear and front angled surfaces 163 and 165 respectively become compressed together and frictionally engaged due to the rearward axial displacement of barrel extension 100 by barrel extension camming notches 170 described elsewhere herein. In one exemplary embodiment, angled locking surfaces 163, 165 may each be angled at about +/−45 degrees to longitudinal axis LA. Other suitable angles larger or smaller than 45 degrees may be used however. Preferably, angled locking surfaces 163 and 165 have approximately the same angles, but with opposite front/rear orientations.

It will be appreciated that in some embodiments, the foregoing second locking mechanism formed between rear angled locking surface 163 on flange 112 of barrel extension 100 and complementary front angled locking surface 165 defined on a front end 166 of each spline 81 in barrel nut 80 (as best shown in FIG. 10) may not be required. In some embodiments, the locking mechanisms provided by (1) barrel locking lug front radial locking surface 104 and corresponding complementary rear radial locking surface 88 on spline 81 of barrel nut 80, and (2) the tapered contact surface 161 of barrel extension 100 and barrel nut 80 described elsewhere herein may be sufficient to secure the barrel extension (and barrel assembly) to the barrel nut and upper receiver 42. Accordingly, flange 112 on barrel extension 100 may be sized and configured such that rear angled locking surface 163 on flange 112 may not engage front angled locking surface 165 of barrel nut 80.

A locator pin 113 may be fitted through hole 116 in the top center of barrel extension 100 (see e.g. FIGS. 13 and 18) to prevent the barrel extension from over-rotating during assembly/disassembly for smooth removal, and for proper orientation during the installation of the barrel extension (and thereby the barrel assembly) into the barrel nut 80.

In a preferred embodiment, referring to FIGS. 14-15 and 19-20, a portion of annular surface 114 of barrel extension 100 defines a tapered contact surface 161 as already noted herein to form a third locking mechanism between the barrel extension and barrel nut 80 to now be further described. Tapered contact surface 161 forms a frustoconical portion that extends circumferentially in an annular band or ring around exterior surface 101 of barrel extension 100. Tapered contact surface 161 engages at least a portion of the axial contact surface 160 (see FIG. 9) of each barrel nut spline 81 to form a frictional lock between the barrel extension and barrel nut when these two components are locked together. This creates a compressive locking force F3 between tapered contact surface 161 and splines 81, as shown in FIG. 4. In one embodiment, tapered contact surface 161 may be disposed adjacent to flange 112 of barrel extension 100. This creates a frictional lock proximate to the front of barrel nut and forward of barrel locking lugs 103 (see FIG. 4) at an axial locking location different than and spaced part from the axial locking location formed by barrel locking lugs 103 and the barrel nut. Engagement between tapered contact surface 161 of barrel extension 100 and axial contact surface 160 of splines 81 form an intermittent pattern of contact extending circumferentially around barrel extension 100. Tapered contact surface 161 in a preferred embodiment has an increasing slope in the axial direction from the rear point P1 of surface 161 to the front point P2 of surface 161 behind flange 112 such that an outer diameter D1 measured at P2 is larger than outer diameter D2 measured at P1 (see e.g. FIG. 14). When barrel extension 100 is fully inserted and seated in barrel nut 80, an axial contact pressure zone 115 is formed between a forward portion of each spline 81 near front end 166 along axial contact surface 160 and tapered contact surface 161 as shown in FIG. 4. In one exemplary embodiment, without limitation, tapered contact surface may have a representative axial length of at least about 0.125 inches measured between points P1 and P2.

Figure 19:
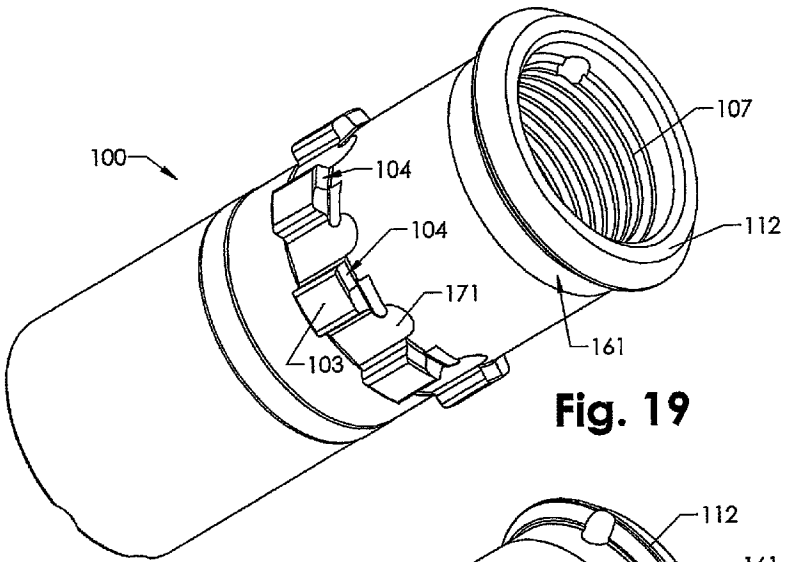
FIGS. 19 and 20 are perspective views looking towards the muzzle end and breech end of the barrel extension, respectively.
Figure 20:
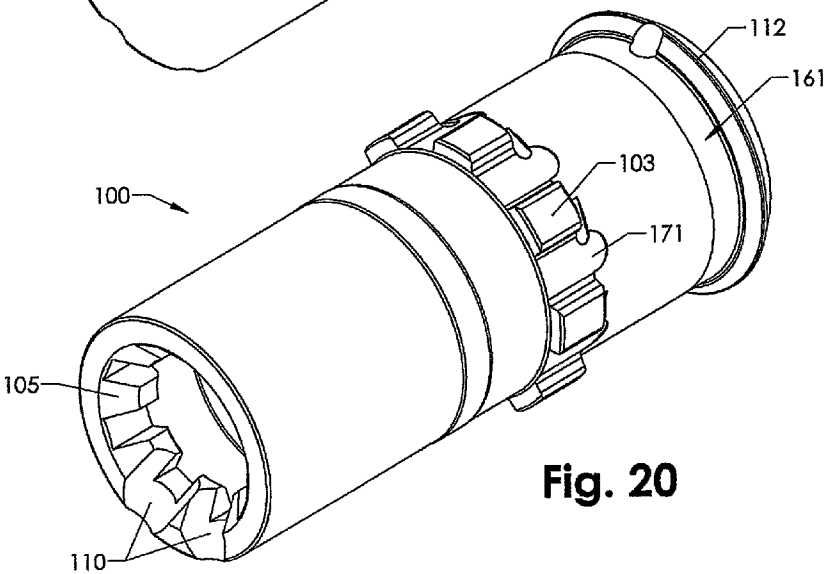

FIGS. 4 and 13 shows barrel extension 100 installed onto barrel 31. FIG. 18 shows an end view of barrel extension 100 with the foregoing features identified. FIGS. 19 and 20 show different perspective views of the barrel extension 100 with the foregoing features identified.

Figure 9:
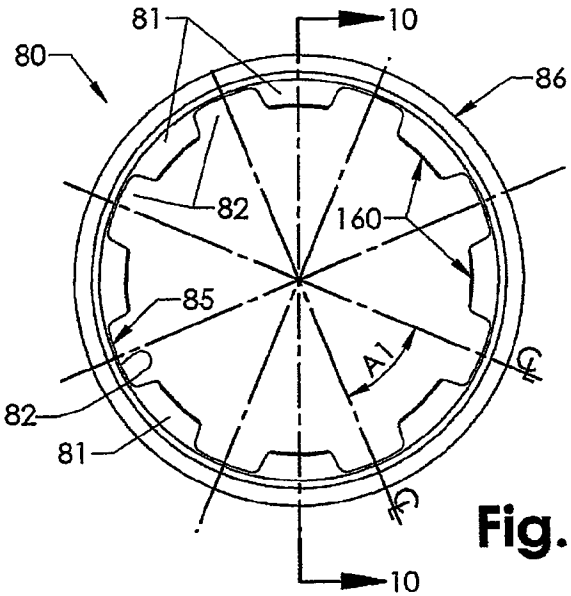
FIG. 9 is an end view of the barrel nut of the rifle looking towards the breech end of the barrel nut.
Figure 12:
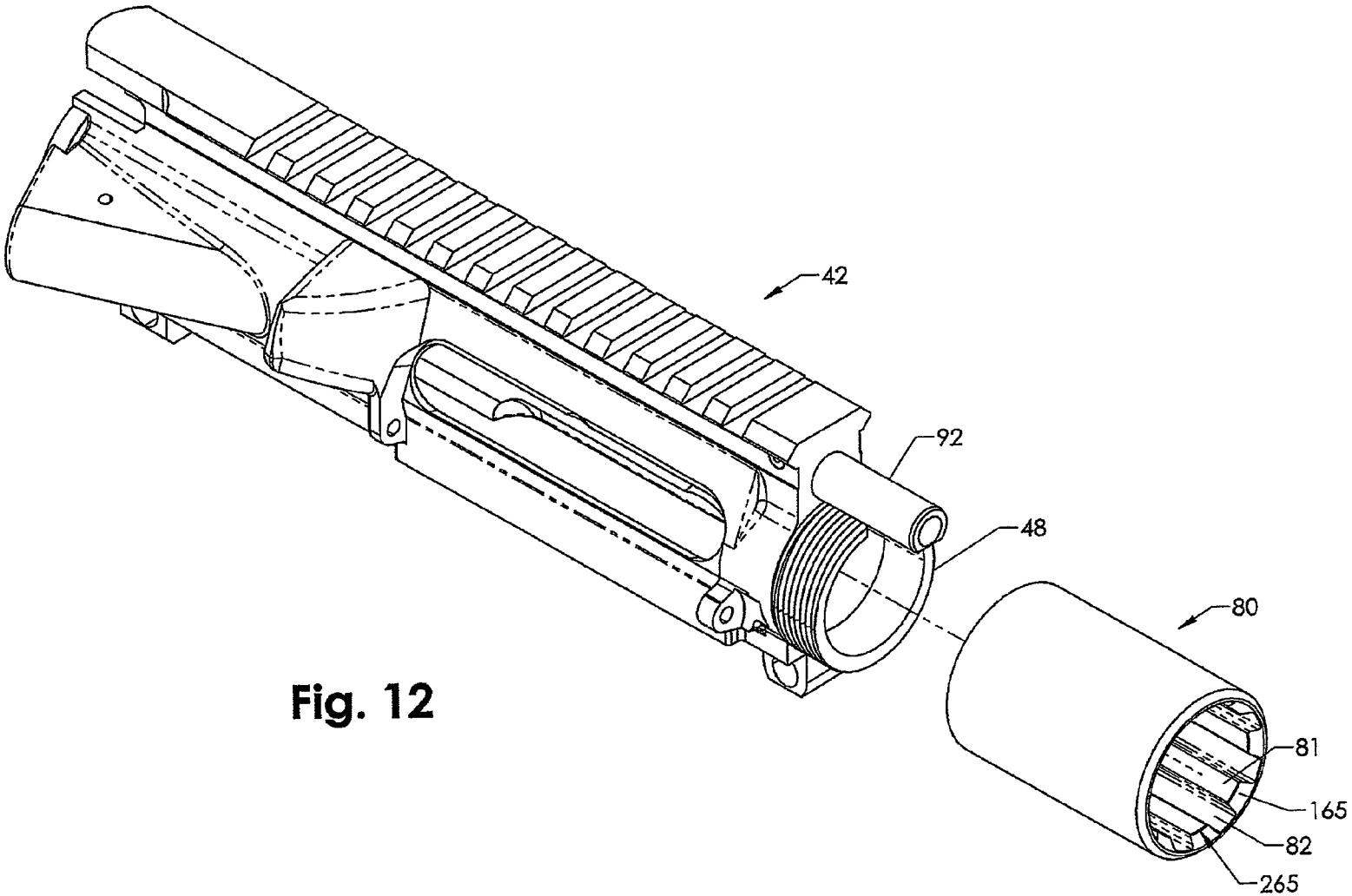
FIG. 12 is a perspective view of the upper receiver and barrel nut.

Barrel Nut: Barrel nut 80 will now be described in further detail. FIGS. 9-11 depict a preferred embodiment of barrel nut 80. FIG. 9 is an end view of barrel nut 80. FIG. 10 is a longitudinal cross-sectional view of barrel nut 80. FIG. 11 shows a detail of barrel nut 80 taken from FIG. 10. FIG. 12 shows barrel nut 80 positioned for attachment to upper receiver 42.

Referring now to FIGS. 9-12, barrel nut 80 according to principles of the present invention is a generally tubular element and includes an axial length L2, a receiver end 83, a barrel end 84, an exterior surface 86, and an interior surface 85. Barrel nut 80 is cooperatively sized and configured with barrel extension 100 to removably receive at least a portion of barrel extension 100 therein.

Barrel nut 80 may be removably or permanently coupled to upper receiver 42. In one possible embodiment, shown in FIG. 12, barrel nut 80 may be removably attached to upper receiver 42 via a threaded connection. Referring to FIG. 10, a portion of interior surface 85 adjacent receiver end 83 of barrel nut 80 may have internal threads 89 configured to removably engage a complementary externally-threaded mounting nipple 48 disposed on the front of upper receiver 42 (see FIGS. 3 and 12). Barrel nut 80 extends in an forward axial direction from the front of upper receiver 42 when mounted thereto. In other possible embodiments contemplated, a portion of exterior surface 86 of barrel nut 80 may alternatively be threaded while the mounting nipple 48 on upper receiver 42 may have complementary internal threads. In some embodiments, barrel nut 80 may also be pinned to upper receiver 42 in addition to threading for a more permanent type installation.

Although threaded attachment of barrel nut 80 to upper receiver 42 is preferred, in other possible embodiments barrel nut 80 may be attached to upper receiver 42 by other commonly known means for assembling firearm components such as set screws, pinning, clamping, etc. Preferably, barrel nut 80 is attached externally to upper receiver 42 to allow the barrel nut to sized larger than if mounted inside the receiver. In some conventional designs having an internal locking sleeve, the barrel locking function and headspacing is done by a trunnion. This means that headspacing will vary from firearm to firearm. When wear pushes the trunnion out of headspacing, the entire firearm such as a rifle must be replaced. In embodiments according to the present invention, since the headspacing is done by the assembly of the barrel extension to the barrel instead, only the quick change barrel would need to be replaced.

In a preferred embodiment, with reference to FIGS. 9-12, barrel nut 80 includes a plurality of locking elements such as splines 81 for engaging and interlocking with barrel locking lugs 103 of barrel extension 100. Splines 81 are preferably arranged in diametrically opposing relationship and circumferentially spaced apart from each other along the interior surface 85 of the barrel nut. Splines 81 extend radially inwards from interior surface 85 of barrel nut 80. In a preferred embodiment, splines 81 are sized and configured to engage both barrel locking lugs 103 and flange 112 of barrel extension 100. Splines 81 may be elongated and extend in a longitudinal direction in barrel nut 80. Each spline includes a front end 166 and a rear end 167 (with the orientation being defined when barrel nut 80 is attached to upper receiver 42 of rifle 20, as shown in FIGS. 4 and 12). In one embodiment shown in FIG. 10, splines 81 preferably extend at least proximate to barrel end 84 of barrel nut 80 to assist with guiding barrel extension 100 into the barrel nut. Accordingly, front end 166 of spline 81 may terminate at barrel end 84 of barrel nut 80. In other embodiments, splines 81 may be spaced inwards from one or both ends 83, 84 of barrel nut 80. Splines 81 may have any suitable axial length. Preferably, splines 81 do not extend into the threads 89 of barrel nut 80.

In the preferred embodiment, the barrel extension 100 is configured and arranged to preferably engage both front and rear ends 166, 167 of at least some of the splines 81 to lock the barrel extension to the barrel nut 80, and more preferably the barrel extension engages all of the splines. As described herein, this is provided by barrel extension 100 including axially spaced-apart opposing surfaces that engage front and rear ends 166, 167 of the splines 81, which in some embodiments is provided by front radial locking surface 104 of barrel locking lugs 103 and rear angled locking surface 163 of flange 112.

Any suitable number of splines 81 may be provided so long as a secure locking relationship may be established between barrel unit 30 and rifle 20. In a preferred embodiment, the number of splines 81 may match the number of barrel locking lugs 103 of barrel extension 100. In one embodiment, by way of example as shown in FIGS. 9-11 without limitation, eight raised splines 81 may be provided that correspond with eight barrel locking lugs 103. Other suitable numbers of splines 81 and barrel locking lugs 103 may be used. Preferably, the splines 81 have a uniform circumferential spacing such that the splines are equally spaced around the circumference of barrel nut 80. In one exemplary embodiment, the radial centerline of each spline 81 is angularly arranged at an angle A1 of about +/−45 degrees from each other (see FIG. 9) wherein eight splines are provided.

With continuing reference to FIGS. 9-11, splines 81 define longitudinally-extending channels 82 formed between pairs of splines along interior surface 85 of barrel nut 80 for slidably receiving therein complementary configured and dimensioned barrel locking lugs 103, which in one preferred embodiment may be formed on a barrel extension 100 as further described herein. Splines 81 and/or channels 82 preferably extend at least partially along the axial length L2 of barrel nut 80. In addition, splines 81 and/or channels 82 may include continuous or intermittent portions disposed along the length L2 of the barrel nut 80.

Referring now to FIG. 10, barrel nut 80 preferably includes an annular locking groove 87 that receives and locates barrel locking lugs 103 of barrel extension 100. Locking groove 87 extends circumferentially along interior surface 85 of the barrel nut. Preferably, in one embodiment, locking groove 87 is oriented transverse and perpendicular to longitudinal axis LA of rifle 20. Locking groove 87 communicates with longitudinally-extending channels 82 such that barrel locking lugs 103 may be slid along the channels and enter the groove when barrel extension 100 is inserted into barrel nut 80. When barrel locking lugs 103 are positioned in locking groove 87, barrel extension 100 and barrel 31 attached thereto may be rotated to lock and unlock the barrel from the barrel nut 80 and rifle 20. In a preferred embodiment, locking groove 87 bisects splines 81 to define a group of front splines 190 and rear splines 191 on either side of the groove as shown. In a preferred embodiment, front splines 190 disposed forward of locking groove 87 define active locking elements of barrel nut 80 which engage barrel extension 100 to secure the barrel extension to the barrel nut. This group of front splines 81 is wedged between annular flange 112 and barrel locking lugs 103 of barrel extension 100 for detachably and rotatably locking barrel assembly 30 to rifle 20 in a manner further described herein. In some embodiments contemplated (not shown), rear splines 191 may be omitted or need not contribute to assisting with locking the barrel extension 100 to barrel nut 80.

With additional reference to FIG. 11, a rear portion of each spline 81 defines rear radial locking surface 88 for mutually engaging a corresponding and complementary configured front radial locking surface 104 formed on barrel locking lugs 103. Rear radial locking surface 88 on spline 81 is preferably disposed at angle A2 to interior surface 85 of barrel nut 80. Preferably, interior surface 85 is oriented generally parallel to longitudinal axis LA of rifle 20 in some embodiments. In one exemplary embodiment, angle A2 may be at least about 90 degrees, and more preferably at least about 100 degrees allowing for fabrication tolerances. Other suitable angles larger than 90 degrees may be used. It is well within the ambit of one skilled in the art to determine and select a suitable angle A2 for locking surface 88 and angle A3 for locking surface 104 of barrel locking lugs 103 (see FIG. 14). Barrel nut splines 81 and barrel locking lugs 103 preferably each have a complementary radial height selected such that barrel locking lugs 103 cannot be axially removed from inside annular locking groove 87 when locking lugs 103 are radially aligned behind the splines and positioned in the groove.

In a preferred embodiment, splines 81 each define an axial contact surface 160 for engaging a portion of annular tapered contact surface 161 of barrel extension 100, as shown in FIGS. 9 and 10 and described elsewhere herein in greater detail. When barrel extension 100 is inserted into barrel nut 80, a forward portion of each axial contact surface 160 will engage at least a portion of tapered contact surface 161.

In contrast to prior known cast or extruded barrel aluminum barrel nuts, barrel nut 80 in the preferred embodiment is made of steel for strength and ductility since barrel assembly 30 locks directly into the barrel nut. In one preferred embodiment, barrel nut 80 may be forged to provide optimum strength, and more preferably may be forged using a commercially-available hammer mill and process generally described in commonly assigned copending U.S. patent application Ser. No. 11/360,197 (Publication No. 2007/0193102 A1), which is incorporated herein by reference in its entirety. Forging provides barrel nut 80 with greater strength and ductility than cast steel. Preferably, barrel nut 80 is made of a steel or steel alloy commonly used in the art for firearm components and suitable for forging. Barrel nut 80 may be forged in the hammer mill by slipping a tubular steel blank or workpiece over a steel barrel nut form having a reverse impression of splines 81 and channels 82. The steel blank is then rotated continuously and simultaneously fed axially through a series of circumferentially-spaced and diametrically-opposed reciprocating impact hammers. The impact hammers strike the exterior surface of the steel blank, which displaces and forces the metal into a shape conforming to the barrel nut form to produce internal splines 81 and channels 82. Locking groove 87, locking surfaces 88, 165 on splines 81, threads 83, and other features may subsequently be machined using conventional techniques well known to those skilled in the art. In some embodiments, for example, the foregoing features of barrel nut 80 may be cut on a CNC turning center (lathe) except for the orientation pin 113 slot that may be milled into the face of the barrel nut during assembly, which may be done in a vertical machining center (CNC vertical milling machine).

Figure 7:
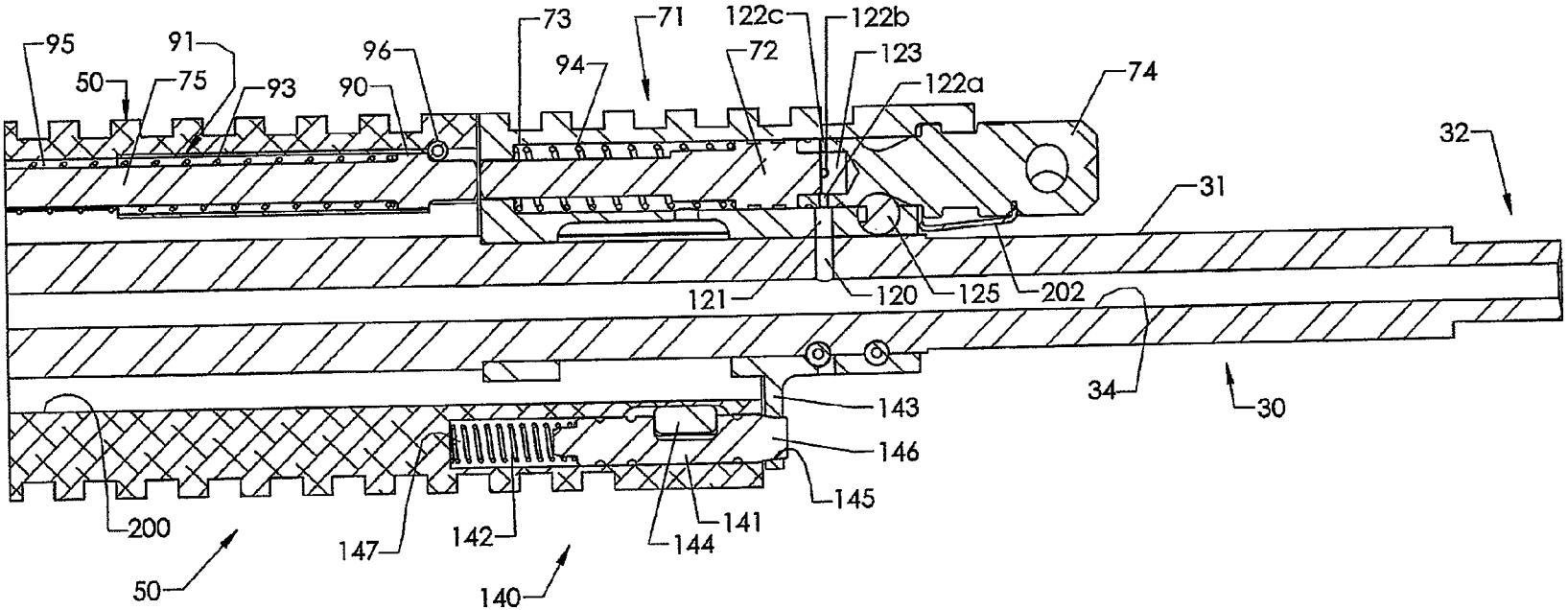
FIG. 7 is a partial cross sectional view of the muzzle end of the barrel.
Figures 8A, 8B:
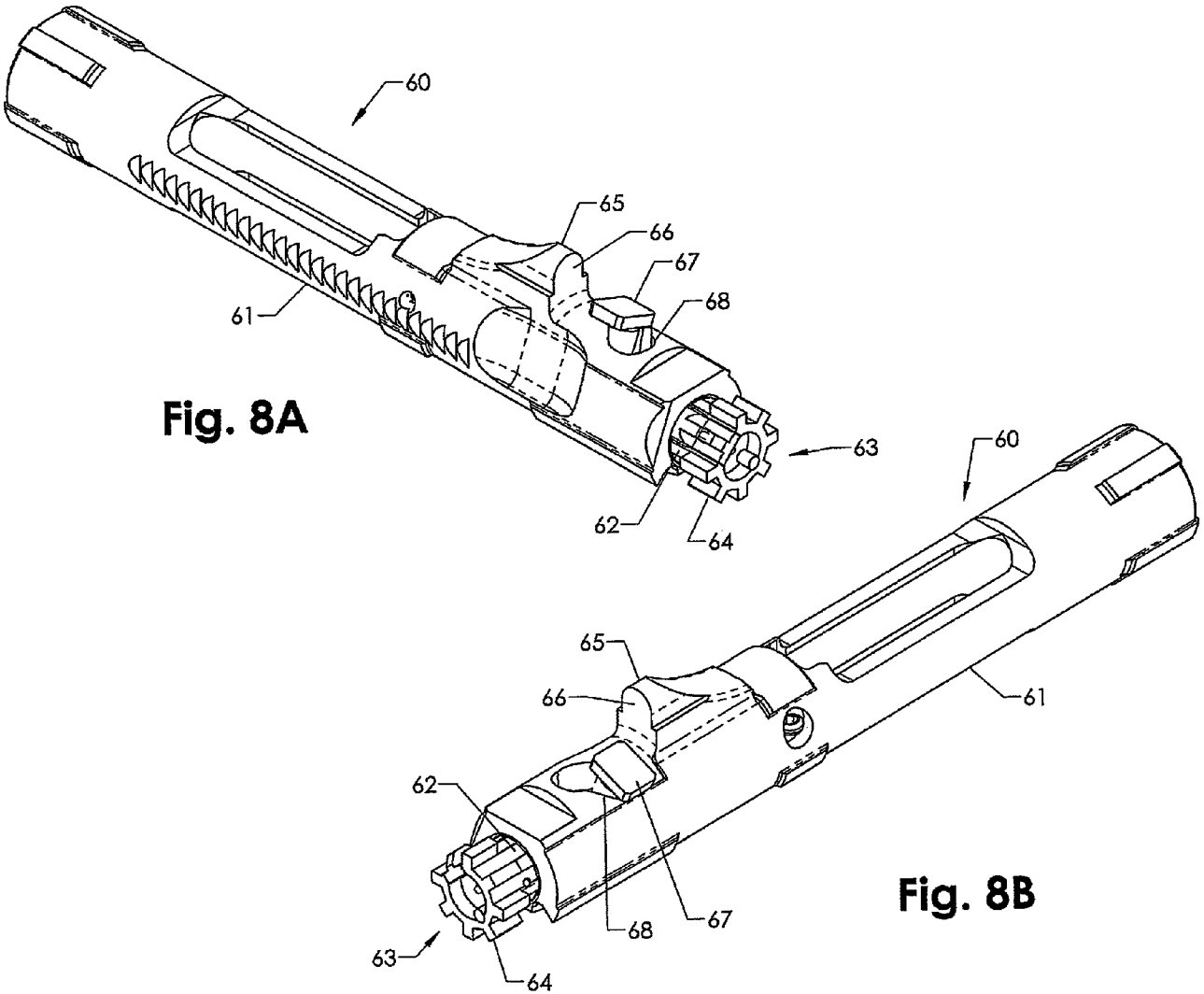
FIG. 8A is a right perspective view of the reciprocating bolt assembly with rotating bolt of the rifle.
FIG. 8B is a left perspective view of the reciprocating bolt assembly with rotating bolt of the rifle.

Handguard: In a preferred embodiment, a handguard 50 may be provided as shown in FIGS. 1, 3, and 7 to protect the users hands from direct contact with a hot barrel 31 after discharging rifle 20. Handguard 50 includes a top, bottom and side portions that extend longitudinally forward from upper receiver 42. Handguard 50 may be of unitary construction or separate top, bottom and side portions that may be permanently or detachably attached together. Preferably, handguard 50 is mounted to upper receiver 42 in a manner such that the handguard is supported by the upper receiver independently of the barrel assembly 30. In one possible embodiment, as shown in FIG. 4, handguard 50 may be coupled to upper receiver 42 by a transverse-mounted pins 270, 271. Bottom pin 270 may be pinned partially through barrel nut 80. Top pin 271 may be pinned partially through tubular bushing 92 affixed to upper receiver 42. In one exemplary embodiment, top pin 271 may be a coiled spring pin or a solid pin. This mounting arrangement allows the barrel assembly 30 to be removed and replaced from rifle 20 while handguard 50 remains in place attached to upper receiver 42. Advantageously, it is not necessary in the preferred embodiments to remove handguard 50 or portions thereof in order to gain access to a barrel nut or other retaining member unlike prior known designs for removing the barrel. Accordingly, the preferred embodiment of a barrel retaining system is intended to reduce the time required to change barrels and eliminate the need to tools. As best shown in FIG. 7, handguard 50 defines an longitudinally-extending internal chamber 53 having a forward-facing opening to receive and house barrel 31.

In one embodiment, as shown if FIG. 1, at least a portion of handguard 50 is preferably provided with accessory mounting rails 52, such as Picatinny-style rails per US Government Publication MIL-STD-1913 Revision 10 (July 1999) or a similar suitable handguard. These rails allow a variety of accessories to be mounted to rifle 20 such as scopes, grenade launchers, tactical flashlights, etc. as conventionally used with field-type rifles. In one embodiment, upper receiver 42 may include accessory mounting rails 52 as shown.

Figures 5, 6A, 6B:
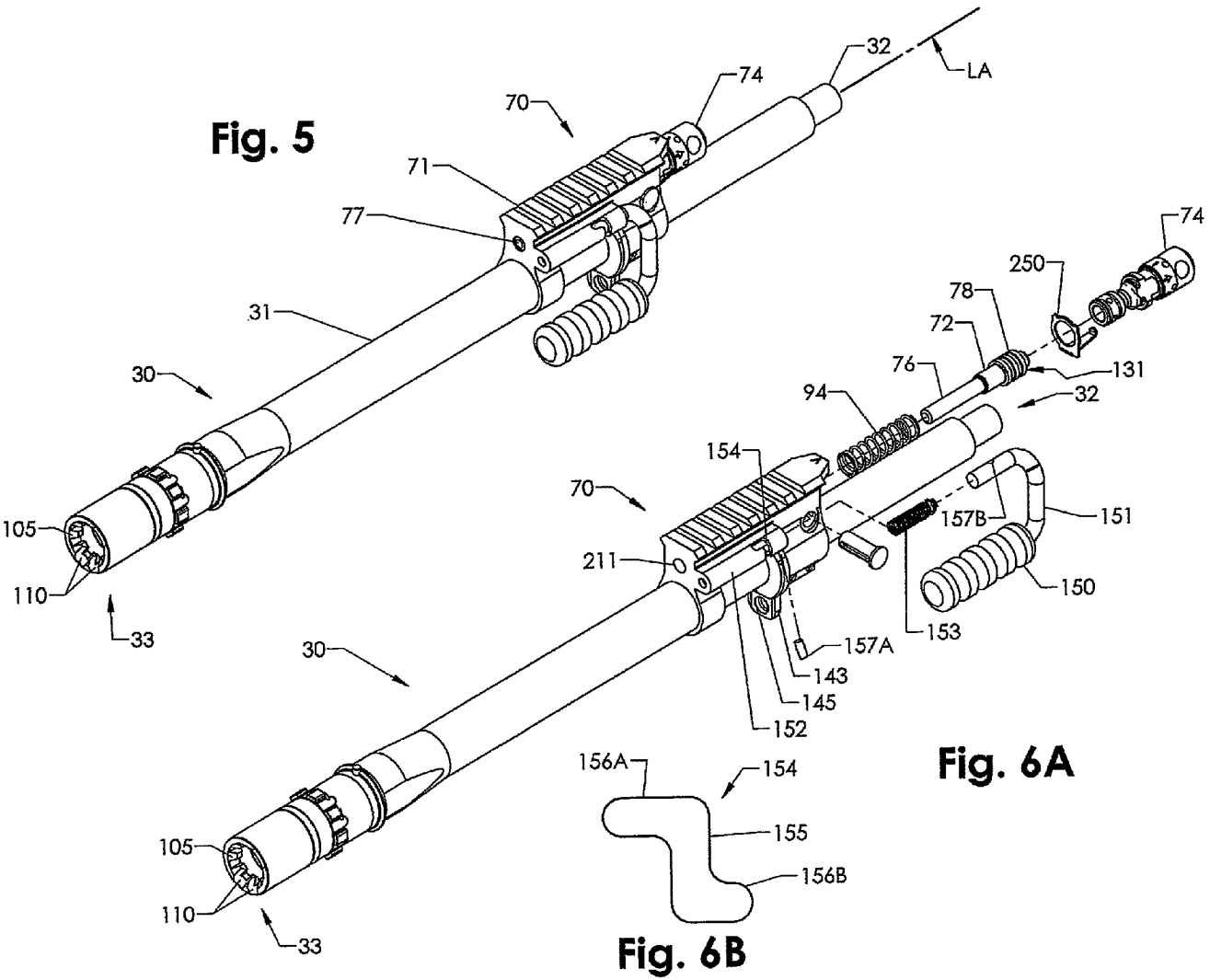
FIG. 5 is a perspective assembled view of the quick-change barrel assembly of the rifle.
FIG. 6A is a perspective exploded view of the quick-change barrel assembly of the rifle.
FIG. 6B is a detailed view of the barrel handle guide notch in the gas block in FIG. 6A.

Gas Piston System: In a preferred embodiment, rifle 20 includes a gas piston operating system 70 which automatically cycles the action of the rifle. FIGS. 5 and 6A show a perspective view and exploded perspective view, respectively, of the gas piston system 70 and gas block 71 mounted on barrel assembly 30. FIG. 7 shows a perspective view of the gas block alone.

Referring now to FIGS. 2, 3, and 5-7, gas piston operating system 70 generally includes gas block 71, a cylindrical piston bore 73 defined therein, a gas piston 72 slidably received in piston bore 73, variable pressure regulator 74, and transfer rod 75. In one embodiment, gas block 71 may be attached to barrel 31 towards the front portion of the barrel by any suitable conventional known means (e.g. pinning, clamping, screws, etc.) and preferably is spaced rearwards from muzzle end 32 as shown. A portion of the combustion gases are bled off from barrel bore 34 and routed to piston bore 73 via (in sequence) port 120 in barrel 31, conduit 121 in gas block 71, one of a plurality of manually selectable lateral orifices in pressure regulator 74 such as orifices 122*a*-122*d*, and axial passageway 123 which opens rearward into piston bore 73 as best shown in FIG. 7. In a preferred embodiment, gas block 71 is mounted on top of barrel 31.

Figure 21:
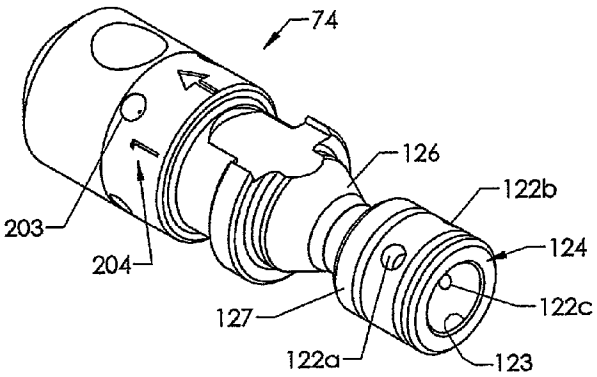
FIG. 21 is a perspective view of the gas pressure regulator of the gas operating system of the rifle.

Referring to FIGS. 7 and 21, pressure regulator 74 is a generally cylindrical component in a preferred embodiment that is rotatably received in the forward portion of piston bore 73. In one embodiment, pressure regulator 74 may be held in gas block 71 via lateral pin 125 that is received in a complementary-shaped annular groove 126 formed in the pressure regulator. However, other suitable means of securing pressure regulator 74 in gas block 71 may be used so long as regulator 74 remains rotatable. Pressure regulator 74 includes a rear face 124 that abuts front face 131 of piston 72 (see FIG. 6A) when both components are mounted in gas block 71. Axial passageway 123 opens through rear face 124 and preferably extends forward partially through the length of pressure regulator 74. A plurality of orifices 122*a*, 122*b*, 122 *c*, and 122*d* (not shown, but opposite orifice 122*b* in FIG. 7) are provided which extend laterally through the sidewall 127 of pressure regulator 74 and communicate with axial passageway 123. Preferably, each orifice 122*a*-122*d* is configured similarly, but has a different diameter than all other orifices to allow the combustion gas flow quantity and pressure to be selectably varied by the user upon rotating different orifices into lateral alignment with conduit 121 of gas block 71 and port 120 of barrel 31 (see FIG. 7). This is intended to allow the user to vary the pressure in piston bore 73 for proper operation of the gas piston system 70 and cycling of the spring-loaded action based on the type of ammunition being used, length of barrel, or other factors which may affect the operating pressure of the gas piston system. A spring clip 202 may be provided that engages detents 203 in pressure regulator 74 (see FIG. 21) to assist retaining the regulator in the user-variable position selection. Other suitable means of fixing the position of pressure regulator 74 may be used. Alphanumerical indicia 204 may be provided on pressure regulator 74 as shown in FIG. 21 to assist users with repeatedly selecting various desired orifices 122*a*-122*d*.

Although a preferred embodiment includes a pressure regulator 74, in other embodiments contemplated a non-variable gas pressure system may be provided. The pressure regulator may therefore be replaced by a fixed diameter axial passageway fluidly connecting the port 120 in barrel 31 with the piston bore 73. Accordingly, the invention is not limited in its applicability to any particular variable or non-variable pressure system.

Referring to FIGS. 2 and 5-7, piston 72 includes a cylindrical head 78 and adjacent cylindrical stem 76 formed integral with or attached to head 78. Piston head 78 in one embodiment may be enlarged with respect to piston stem 76. Preferably, a rear end 77 of piston stem 76 (see FIG. 5) protrudes through a hole in the rear of gas block 71 at the rear of piston bore 73. Transfer rod 75 detachably contacts and engages rear end 77 of piston stem 76 in an abutting relationship in a preferred embodiment. Preferably, transfer rod 75 and piston 72 are separate components that are separable from each so that barrel unit 30 may be removed from rifle 20 without removing the transfer rod, as will be further described herein.

As shown in FIG. 3, transfer rod 75 extends rearwards into upper receiver 42 to engage bolt carrier key 65 of bolt carrier 61 for cycling the action. The rear end of transfer rod 75 is positioned to contact and abut forward-facing thrusting surface 66 of bolt carrier key 65 in an abutting relationship without a fixed or rigid connection between surface 66 and key 65. The rear portion of transfer rod 75 is slidably supported by upper receiver 42 for axial movement therein. In one embodiment, a tubular bushing 92 may be provided in upper receiver 42 to slidably receive and support transfer rod 75. The front portion of transfer rod 75 is supported by handguard 50 as shown in FIG. 7. In a preferred embodiment, handguard 50 contains a longitudinally-extending cavity 95 that movably receives transfer rod 75. Handguard 50 may include a tubular collar 91 located in the front of the handguard proximate to gas block 71 as shown to support transfer rod 75. In one embodiment, transfer rod 75 may include an annular flange 90 positioned proximate to the front of the transfer rod so that intermediate portions of the rod between flange 90 and bushing 92 do not engage cavity 95. This reduces friction and drag on the transfer rod 75 when it is driven rearward by piston 72 to cycle the action after discharging rifle 20.

With continuing reference to FIGS. 2, 3 and 5-7, piston 72 is axially biased in a forward direction by a biasing member such as piston spring 94. Preferably, spring 94 is disposed in piston bore 73 and has one end that abuts gas block at the rear of the piston bore and an opposite front end that acts on piston head 74. Spring 94 keeps piston head 74 abutted against the rear of pressure regulator 74 when the gas piston operating system 70 is not actuated. In a preferred embodiment, transfer rod 75 is axially biased in a forward direction by a separate biasing member such as transfer rod spring 93 as shown in FIGS. 3 and 7. In one embodiment, transfer rod spring 93 is disposed about at least a portion of transfer rod 75 and positioned in cavity 95 of handguard 50 with the transfer rod. Transfer rod spring 93 preferably keeps the front of transfer rod 75 biased against rear end 77 of piston stem 76. Spring 93 has a rear end that abuts upper receiver 42, and in some embodiments bushing 92 as shown. An opposite front end of spring 93 abuts flange 90 on transfer rod 75. Preferably, a travel stop such as transverse pin 96 (see FIG. 7) may be provided to prevent transfer rod 75 from being ejected forward and out from handguard cavity 95 when gas block 71 is removed from rifle 20 as further described herein. Accordingly, in a preferred embodiment, spring-biased transfer rod 75 is self-contained in handguard 50 and rifle 20 independent of the spring-biased piston 72 associated with gas block 71 so that barrel assembly 30 with gas block 71 may be removed from rifle 20 without removing the transfer rod.

Barrel Latching Mechanism: Referring to FIGS. 2 and 5-7, the quick-change barrel retaining system further includes a front barrel latching mechanism 140 for securing the barrel assembly 30 to handguard 50. This is intended to provide a secure connection between the forward portions of barrel assembly 130 and handguard 50 to stabilize the barrel, and prevents the barrel assembly from being unintentionally rotated which might disengage the barrel assembly from barrel nut 80 at the rear. In addition, the latching mechanism 140 provides additional rigidity between the barrel assembly 30 and handguard 50 when grenade launchers are mounted to and used with rifle 20. In a preferred embodiment, barrel latching mechanism is associated with handguard 50. In one embodiment, front barrel latching mechanism 140 includes spring-loaded latch plunger 141 which is disposed in latch plunger cavity 147 of handguard 50 for axial movement therein. Latch plunger 141 engages barrel assembly 30 for detachably locking the barrel assembly to handguard 50. Latch plunger 141 engages an aperture 145 in barrel assembly 30, which in a preferred embodiment may be formed in a latch flange 143. At least a portion of latch plunger 141 protrudes through and engages latch flange 143 to secure the barrel assembly 30 to handguard 50. The front end 146 of latch plunger 141 may be tapered and aperture 145 may have a complementary taper to assist in centering/guiding the latch plunger into the aperture and forming a secure frictional fit. In one embodiment, latch flange 143 may conveniently be formed as part of gas block 71 as shown. In other embodiments contemplated, latch flange may be a separate component from the gas block 71 and secured to or integral with barrel 31 independently of the gas block. Latch plunger 141 is preferably biased in a forward axial direction as shown by latch spring 142 which is disposed in latch plunger cavity 147. This keeps latch plunger 141 seated in the latch flange 143.

Barrel latching mechanism is movable from a latched position shown in FIG. 7 in which latch plunger 141 engages latch flange 143 to an unlatched position (not shown) in which plunger 141 is withdrawn from aperture 145 and flange 143.

To assist with drawing latch plunger 141 from aperture 145 in latch flange 141, a latch trigger 144 is provided which may engage or be integral with the latch plunger. In one embodiment, latch trigger 144 preferably extends in a lateral direction from latch plunger 141 transverse to the longitudinal axis LA of rifle 20, and more preferably may extend sideways from rifle 20 and handguard 50. However, other suitable arrangements are contemplated and may be used for latch trigger 144.

In one embodiment, barrel latching mechanism 140 may be disposed in handguard 50 on the bottom of the handguard opposite gas block 71. In other embodiments contemplated, barrel latching mechanism 140 may be disposed in other suitable positions such as on either side or the top of gas block 71. Accordingly, the invention is not limited to any particular position or configuration of barrel latching mechanism 140 so long as the barrel assembly 30 may be detachably engaged and locked to handguard 50.

Barrel Operating Handle: According to another aspect of the preferred embodiment, a movable barrel operating handle 150 is provided as shown in FIGS. 5, 6A-B, and 22 to facilitate rotating and removing barrel assembly 30 from rifle 20, including when the barrel assembly is hot. Barrel handle 150 provides lever so that the user can readily apply the required rotational force required to lock and unlock barrel assembly 30 from rifle 20. Using the barrel handle 150, barrel assembly 30 can further be replaced without the use of separate tools in a preferred embodiment.

Referring now to FIGS. 5, 6A-B, and 22, barrel handle 150 is preferably coupled to barrel assembly 30 and rotatable about longitudinal axis LA between a stowed position (shown in FIG. 22) in which the handle is tucked in proximate to barrel assembly 30 and a deployed position (shown in dashed lines in FIG. 22) in which the handle extends outwards farther from the barrel assembly than in the stowed position to provide a mechanical advantage to the user. Barrel handle 150 may be movably coupled to gas block 71 via a handle rod 151 which is received in a socket 152 disposed in the gas block. Handle rod 151 may be generally U-shaped in a preferred embodiment having barrel handle 150 disposed on one end of the rod and the other end of the rod being inserted into socket 152. Handle rod 151 may be forward biased by a spring 153 which is carried in socket 152 and acts on the rod. In a preferred embodiment, gas block 71 includes a configured guide notch 154 having an arcuate vertical portion 155 oriented transverse to the longitudinal axis LA and a horizontal straight top portion 156A and bottom portion 156B extending axially in opposite directions. Notch 154 communicates with socket 152. Handle rod 151 includes a transverse pin 157A in a preferred embodiment as shown that fits in hole 157B in handle rod 151 and travels in notch 154 for guiding and limiting movement of barrel handle 150.

Operation of Quick-Change Barrel Retaining System: Operation of the barrel retaining system according to principles of the present invention for rifle 20 will now be described starting with the barrel removal process. Initial reference is made to FIGS. 1 and 2 showing barrel assembly 30 already mounted in rifle 20. All references made to orientation and direction are for convenience only and from the perspective of a user facing towards the rear of rifle 20 and looking at the muzzle end 32 of barrel 31.

Barrel assembly 30 is shown in FIGS. 1 and 2 in a ready-to-fire position with barrel extension 100 being in the locked position engaged with barrel nut 80. The front portion of barrel assembly 30 is secured to handguard 50 via latching mechanism 140 at the front of the handguard. Barrel locking lugs 103 are rotationally engaged with splines 81 such that front radial locking surface 104 of the barrel locking lugs are engaged with rear radial locking surface 88 on spline 81 of barrel nut 80. In a preferred embodiment, each barrel locking lugs 103 is positioned behind each corresponding spline 81 preferably so that the radial centerline of each barrel locking lugs is approximately axially aligned with the centerline of each spline when the barrel extension is fully locked into the barrel nut. In other embodiments contemplated, barrel locking lugs 103 may only partially engage splines 81 by a sufficient amount to secure lock barrel extension 100 to barrel nut 80, wherein the centerlines of splines 81 and barrel locking lugs 103 are not fully in axial alignment. Accordingly, complete axial alignment is not necessary in some embodiments to securely mount barrel assembly 30 to rifle 20.

In the ready-to-fire position of barrel assembly 30 shown in FIGS. 1 and 2, rear angled locking surface 163 of flange 112 is preferably engaged and compressed against front angled locking surfaces 165 of splines 81. Accordingly, the splines 81 are wedged between flange 112 and barrel locking lugs 103. In some embodiments where a frustoconical portion is optionally provided on barrel extension 100, tapered contact surface 161 formed by the frustoconical portion is engaged with axial contact surface 160 disposed on top of each spline 81.

Figure 22:
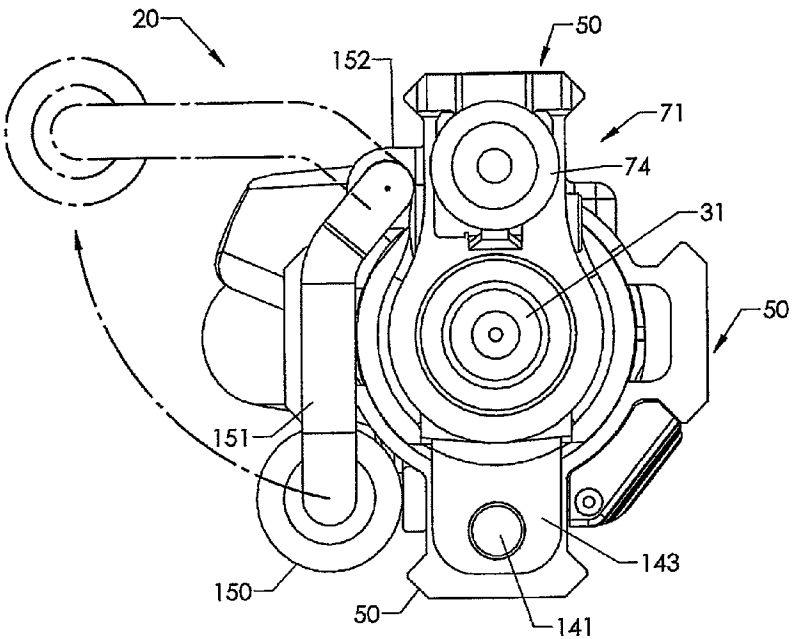
FIG. 22 is a front view of the muzzle end of the rifle looking towards the receiver.

To remove mounted barrel assembly 30 from rifle 20, with additional reference to FIGS. 5-7 and 22, the user first rotates stowed barrel handle 150 in a clockwise direction about longitudinal axis LA and moves the handle to the extended deployed position (shown by dashed lines in FIG. 22). The user also activates the barrel latching mechanism 140 by pulling rearwards on latch trigger 144 to disengage and withdraw latch plunger 141 from aperture 143 of latch flange 143. This effectively uncouples barrel assembly 30 from handguard 50 and allows the barrel assembly to be freely rotated independent from the stationary handguard still attached to receiver assembly 40. It will be appreciated that the steps of deploying barrel handle 150 or activating barrel latching mechanism 140 may be done in any order or essentially simultaneously.

Preferably using barrel handle 150, while holding latch trigger 144 and latch plunger 141 coupled thereto rearwards, the user next rotates barrel assembly 30 clockwise about longitudinal axis LA towards a second unlocked position. Rotating barrel assembly 30 simultaneously rotates barrel extension 100 coupled thereto in the same direction and unlocks barrel locking lugs 103 from splines 81 in barrel nut 80 with the barrel locking lugs turning in circumferential locking groove 87. Front radial locking surface 104 of barrel locking lugs 103 disengage rear radial locking surface 88 on spline 81 of barrel nut 80 (see additionally FIGS. 3, 4, 9-10 and 14-15) and relieve the compressive force F1 therebetween (reference FIG. 4). Barrel locking lugs 103 now are axially aligned with channels 82 of barrel nut 80 to allow the barrel extension 100 of barrel assembly 30 to be axially withdrawn forward from barrel nut 80. In one exemplary preferred embodiment, described herein, eight barrel locking lugs 103 and eight splines 81 and channels 82 may be provided and arranged such that rotating barrel assembly 30 (with barrel extension 100) clockwise by approximately +/−22.5 degrees or a ⅛ turn will disengage barrel locking lugs 103 from splines 81 of barrel nut 80 and align the barrel locking lugs with channels 82. This correlates to the top of barrel assembly 30 and gas block 71 being approximately between a 1-2 o'clock position (from a user's perspective facing towards the rear of rifle 20). When each barrel locking lugs 103 is positioned in alignment with channels 82 of barrel nut 80, the compressive engagement and compressive force F2 between rear angled locking surface 163 of flange 112 (on barrel extension 100) and front angled locking surface 165 (on barrel nut 80) is also relieved (reference FIG. 4). In some embodiments having a frustoconical portion provided on barrel extension 100, compressive force F3 between tapered contact surface of barrel extension 100 and axial contact surface 160 of splines 81 is also relieved (reference FIG. 4).

Referring to FIG. 7, because piston 72 is separately disposed in gas block 71 and not integral with transfer rod 75, any surface-to-surface contact between the transfer rod and piston stem 76 is broken when barrel assembly 30 is rotated clockwise. Transfer rod 75, however, remains stationary in position being mounted in handguard 50.

The user next slides barrel assembly 30 in an axial forward direction thereby sliding barrel locking lugs 103 in channels 81 to withdraw the barrel extension 100 from barrel nut 80. The user continues to move barrel assembly 30 forward and withdraws the entire barrel assembly 30 from within handguard 50 to complete the barrel removal. The disembodied barrel assembly 30 would appear as shown in FIG. 5 and can be replaced with another barrel assembly of the same or different type and/or barrel length. Handguard 50 remains attached to receiver assembly 40.

To install a new barrel assembly 30, the foregoing process is essentially reversed. Generally, new barrel assembly 30 is oriented with the top of barrel assembly 30 at between about the 1-2 o'clock radial position corresponding to the removal position of the old barrel. The barrel assembly 30 is inserted axially rearwards through the front of handguard 50 until barrel extension 100 is fully inserted into and seated in barrel nut 80. Barrel locking lugs 130 will enter and slide rearwards in channels 82 of barrel nut 80. Annular flange 112 will contact/abut front angled locking surfaces of each spline 81 on barrel end 84 of barrel nut 80 and to tactilely indicate to the user that the barrel extension is fully inserted (see FIG. 4). In addition, barrel extension 100 is preferably configured and dimensioned such that barrel locking lugs 103 will concomitantly be located and fall into proper position within locking groove 87 of barrel nut 80 when flange 112 abuts the barrel nut. With the user then either retracting latch plunger 141 rearwards again (via the latch trigger 144) if previously released after removing the barrel or still holding latch plunger 141 rearwards if not released before, the user then rotates barrel assembly 30 counterclockwise (by about +/−22.5 degrees or a ⅛ turn in the preferred embodiment described herein) until gas block 71 is at top center position and aperture 145 of latch flange 143 is axially aligned again with latch plunger 141. This rotationally engages barrel locking lugs 103 with splines 81 to lock barrel extension 100 into barrel nut 80 in the manner already described herein. The camming action between spline 81 and camming notch 170 (see FIG. 16) disposed at front radial locking surface 104 of each barrel locking lug 103 displaces barrel extension 100 slightly rearward in the manner already described herein. Front radial locking surface 104 of barrel locking lugs 103 now rotationally engages and is fully compressed against rear radial locking surface 88 of splines 81 (see FIG. 4, compressive locking force F1). The rearward displacement of barrel extension 100 also fully compresses rear angled locking surface 163 of flange 112 against front angled locking surface 165 of spline 81 (see FIG. 4, compressive locking force F2) such that the splines 81 are wedged between the barrel locking lugs and flange of the barrel extension. In some embodiments where provided, tapered contact surface 161 of barrel extension 100 becomes fully compressed into axial contact surface 160 on top of spline 81 with the rearward axial displacement of the barrel extension caused by camming notches 170. This causes an increasing annular frictional force fit between tapered contact surface 161 contact surface 160 of the splines 81 (see FIG. 4, compressive locking force F3) as barrel extension 100 moves rearward relative to barrel nut 80.

With barrel assembly 30 fully seated and rotated into its final locked and ready-to-fire position, the user may release latch trigger 144 so that latch plunger 141 enters aperture 145 of latch flange 143 to lock the front of barrel assembly 30 to handguard 50 (see, e.g. FIG. 7). Barrel assembly 30 is now fully locked to rifle 20 which is ready to be fired.

Although the barrel retaining system according to principles of the present invention has been described for convenience with reference to a firearm in the form of an rifle, it will be appreciated that the invention may be used with any type of firearm or weapon wherein a rotatable attachment of a barrel to a frame or receiver may be beneficially used, such as in pistols, artillery, etc.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes and/or control logic as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A method for mounting a barrel to a firearm comprising:

axially inserting at least a rear portion of a barrel assembly into a barrel nut attached to the firearm;

rotating the barrel assembly in a first direction to a locked position; and engaging a plurality of barrel locking lugs on the barrel assembly with a plurality of axially extending locking elements disposed on the barrel nut, the locking elements being configured such that the barrel assembly cannot be axially removed from the barrel nut when in the locked position.

2. The method of claim 1, wherein the barrel locking lugs are disposed on an exterior surface of the barrel assembly.

3. The method of claim 2, wherein the locking elements comprise a plurality of axially elongated splines formed on an interior surface of the barrel nut.

4. The method of claim 3, further comprising a step of engaging the plurality of splines with an annular flange formed on the barrel assembly, the flange being axially spaced apart from the locking elements.

5. The method of claim 3, further, comprising a step of engaging the splines with a frustoconical portion formed on the barrel assembly.

6. The method of claim 1, wherein the engaging step includes wedging the locking elements disposed on the barrel nut between the barrel locking lugs and a flange formed on the barrel assembly.

7. The method of claim 1, wherein the axially inserting step includes sliding the barrel locking lugs in corresponding axially extending channels formed between the locking elements on the barrel nut.

8. The method of claim 7, further comprising a step of locating the barrel locking lugs on the barrel assembly within an annular locking groove disposed on an interior surface of the barrel nut prior to the rotating the barrel assembly step.

9. The method of claim 1, wherein the rotating step includes engaging the barrel locking lugs with camming notches disposed on the barrel nut.

10. The method of claim 9, further comprising a step of axially displacing the barrel assembly in relation to the barrel nut with the camming notches.

11. The method of claim 1, wherein the barrel assembly further includes a plurality of bolt locking lugs formed on an interior surface of the barrel assembly for engaging a firearm bolt.

12. A method for mounting a barrel to a firearm comprising:

providing a barrel nut attached to the firearm, the barrel nut including a plurality of axially elongated locking splines extending radially from the barrel nut;

axially inserting a rear end of a barrel assembly into the barrel nut;

rotating the barrel assembly in a first direction with respect to the barrel nut to a locked position; and engaging a plurality of radially extending barrel locking lugs on the barrel assembly with the plurality of locking splines on the barrel nut, the locking elements being configured such that the barrel assembly cannot be axially removed from the barrel nut when in the locked position.

13. The method of claim 12, wherein the axially inserting step includes sliding the barrel locking lugs in corresponding axially extending channels formed between the locking splines elements on the barrel nut.

14. The method of claim 13, further comprising a step of sliding the barrel locking lugs from the channels into an annular locking groove disposed on an interior surface of the barrel nut prior to the step of rotating the barrel assembly.

15. The method of claim 14, wherein the barrel assembly is rotatable when the barrel locking lugs are located in the groove but not rotatable when the barrel locking lugs are positioned in the channels in the barrel nut.

16. The method of claim 12, further comprising a step of engaging the plurality of splines with an annular flange formed on the barrel assembly, the flange being axially spaced apart from the locking elements.

17. The method of claim 12, wherein the rotating step includes engaging the barrel locking lugs with camming notches disposed on the barrel nut and axially displacing the barrel assembly in relation to the barrel nut with the camming notches.

18. A method for mounting a barrel to a firearm comprising:

providing a firearm having a barrel nut including a plurality of axially elongated locking splines extending radially inwards from the barrel nut and a corresponding plurality of axially extending channels formed between the splines;

axially inserting a rear end of a barrel assembly into the barrel nut, the barrel assembly including a plurality of barrel locking lugs extending radially outwards from the barrel assembly;

sliding the barrel locking lugs rearward in the channels of the barrel nut to an axial location, the barrel assembly being in an unlocked rotational position wherein the barrel assembly can be axially withdrawn from the barrel nut;

rotating the barrel assembly in a first direction with respect to the barrel nut to a locked position; and positioning the barrel locking lugs in axial alignment with the splines, wherein the barrel assembly cannot be axially withdrawn from the barrel nut in the locked position.

19. The method of claim 18, further comprising locating the barrel locking lugs on the barrel assembly within an annular locking groove disposed on an interior surface of the barrel nut by the sliding step, the barrel assembly being rotatable when the locking lugs are located in the groove but not rotatable when the locking lugs are located in the channels.

20. The method of claim 19, further comprising axially displacing the barrel assembly in relation to the barrel nut by engaging the barrel locking lugs with camming notches formed on the barrel nut, the camming notches communicating with the annular locking groove in the barrel nut.

* * * * *